US005655680A

United States Patent [19]

Asbach et al.

[11] Patent Number: 5,655,680

[45] Date of Patent: *Aug. 12, 1997

[54] ODORLESS CONTAINER

[75] Inventors: Ronald M. Asbach, Grand Island; Seth N. Green; James E. Slowe, both of East Aurora, all of N.Y.

[73] Assignee: Fisher Price, Inc., East Aurora, N.Y.

[ * ] Notice: The term of this patent shall not extend beyond the expiration date of Pat. No. 5,535,913.

[21] Appl. No.: 406,523

[22] Filed: Mar. 20, 1995

Related U.S. Application Data

[63] Continuation-in-part of Ser. No. 326,284, Oct. 20, 1994, Pat. No. 5,535,913.

[51] Int. Cl.[6] ..... B65D 90/04; B65D 43/02; B65D 51/18

[52] U.S. Cl. ..... 220/404; 220/254; 220/502; 220/263; 220/908

[58] Field of Search ..... 220/402, 404, 220/501, 502, 254, 908, 87.1, 263, 602, 288; 383/70; 251/4; 232/44; 4/484

[56] References Cited

U.S. PATENT DOCUMENTS

| | | | |
|---|---|---|---|
| 1,121,161 | 12/1914 | Bowen . | |
| 1,143,597 | 6/1915 | Clement . | |
| 1,169,606 | 1/1916 | Blank et al. . | |
| 1,194,907 | 8/1916 | Watson . | |
| 1,196,385 | 8/1916 | Mutch . | |
| 1,200,772 | 10/1916 | Stanley . | |
| 1,202,469 | 10/1916 | Anzevino . | |
| 1,208,766 | 12/1916 | Frederick . | |
| 1,226,634 | 5/1917 | Briese . | |
| 1,238,010 | 9/1917 | Fisher . | |
| 1,239,348 | 9/1917 | Bunnell et al. . | |
| 1,239,427 | 9/1917 | Bunnell et al. . | |
| 1,265,148 | 5/1918 | Warren . | |
| 1,272,443 | 7/1918 | Himmelberger . | |
| 1,286,368 | 12/1918 | Lucas . | |
| 1,907,082 | 5/1933 | Meltzer . | |
| 1,936,262 | 11/1933 | Poet | 220/86 |
| 2,411,430 | 11/1946 | Hodson | 220/17 |
| 2,946,474 | 7/1960 | Knapp | 220/17 |
| 3,158,874 | 12/1964 | Bennett | 4/484 |
| 3,175,760 | 3/1965 | Worthington | 232/43.2 |
| 3,374,976 | 3/1968 | Kurlander et al. | 248/97 |
| 3,401,409 | 9/1968 | Ekrut | 4/484 |
| 3,595,507 | 7/1971 | Kurlander | 248/97 |
| 3,836,037 | 9/1974 | Bass | 220/35 |
| 3,943,578 | 3/1976 | Miya et al. | 4/484 |
| 4,376,491 | 3/1983 | Banker, Jr. | 383/70 |
| 4,427,110 | 1/1984 | Shaw, Jr. | 206/205 |

(List continued on next page.)

FOREIGN PATENT DOCUMENTS

| | | |
|---|---|---|
| 525134 | 8/1972 | Switzerland . |
| 2226944 | 7/1990 | United Kingdom . |

OTHER PUBLICATIONS

"Turn 'N Seal Diaper Pail" (Product No. 168–The Odor Free Diaper Disposal System), 1994 product catalogue, p. 21.

*Primary Examiner*—Allan N. Shoap
*Assistant Examiner*—Nathan Newhouse
*Attorney, Agent, or Firm*—Morgan, Lewis and Bockius, LLP; C. Scott Talbot

[57] ABSTRACT

An odorless container having a selectively openable peripheral constrictor that creates a seal between a holding chamber where waste is deposited and a storage chamber where waste is stored so that odors from the storage chamber do not escape when waste is deposited into the holding chamber. Operation of the pail involves opening the lid, depositing the waste into the holding chamber, and closing the lid. The constrictor is then opened allowing the waste to fall from the holding chamber into the storage chamber. Finally, the constrictor is closed to prepare the pail for the next deposit of waste. Therefore, odors from the second chamber are never directly exposed to the outside environment. The constrictor may be constructed of a single continuous flexible sleeve, or of multiple constrictor elements, which may be rigid members, articulated members having rigid segments, or elastic or inelastic flexible strands or strips.

30 Claims, 28 Drawing Sheets

U.S. PATENT DOCUMENTS

| | | | |
|---|---|---|---|
| 4,580,688 | 4/1986 | Harris et al. | 220/1 T |
| 4,869,049 | 9/1989 | Richards et al. | 53/459 |
| 4,934,529 | 6/1990 | Richards et al. | 206/303 |
| 4,953,732 | 9/1990 | Cocks | 220/502 |
| 5,022,553 | 6/1991 | Pontius | 220/410 |
| 5,056,293 | 10/1991 | Richards et al. | 53/116 |
| 5,125,526 | 6/1992 | Sumanis | 220/263 |
| 5,147,055 | 9/1992 | Samson et al. | 220/254 |
| 5,158,199 | 10/1992 | Pontius | 220/410 |
| 5,174,462 | 12/1992 | Hames | 220/87.1 |
| 5,211,370 | 5/1993 | Powers | 251/4 |
| 5,385,259 | 1/1995 | Bernstein et al. | 220/404 |
| 5,464,189 | 11/1995 | Li | 251/4 |

ODORLESS CONTAINER

This is a continuation in part of application Ser. No. 08/326,284 filed Oct. 20, 1994, now U.S. Pat. No. 5,535, 913.

BACKGROUND OF THE INVENTION

The invention relates generally to waste disposal, and in particular to a receptacle for temporarily storing odoriferous waste and containing objectionable odors. Children's diapers are a common odoriferous waste material that require temporary storage in the home until they are washed (if reusable) or disposed of (if disposable).

A conventional waste container typically consists of a pail open at one end that serves as a storage chamber and a removable lid to cover the pail's open end. To use such a container, the user removes the lid, deposits the waste in the pail, and replaces the lid. Offensive fumes and odors emanating from the waste material contained in the closed pail accumulate in the pail and assault the user's senses when the lid is next removed. Consequently, routine use of such a conventional garbage pail repeatedly exposes the user, and those nearby, to the offensive odors accumulated in the pail from the previously deposited waste. Furthermore, many such garbage containers do not have an air tight seal between the pail and lid, permitting odors to escape even when the lid is in place.

Several approaches have been taken in designing garbage receptacles that attempt to insulate the user from exposure to the offensive odors accumulated in the receptacle. These approaches can be classified as odor absorbers, inner lids or seals, air locks, and individual packaging.

The odor absorber approach relies on mechanical or chemical absorption or adsorption of accumulated odors. A suitable absorber is disclosed in U.S. Pat. No. 5,174,462 to Hames, which uses an actuated charcoal adsorber mounted in a perforated holder beneath the container lid. Although such absorbers can reduce the amount of objectionable odors, they cannot eliminate them, and they require periodic replacement.

Several devices have been proposed that add an inner lid or seal between the conventional container's pail and outer lid to reduce leakage of odors when the outer lid is closed and/or to minimize the time during which the user is exposed to the odors accumulated in the pail while adding more waste. One example of such a device is described in U.S. Pat. No. 4,427,110 to Shaw, Jr. This device includes a canister and seal insert having a plurality of slits intersecting centrically to provide flexible, sliced pie-shaped sectors adapted to be flexed downward into the canister base. A top has a frusto-conical plunger adapted to flex the sectors of the insert downward to allow a diaper deposited on the insert to fall into the canister. The top also has a handle with a deodorizer.

The Turn 'N Seal Diaper Pail, sold by Safety 1st, also incorporates such an inner lid. This pail also has a mechanism for twisting closed the neck of a plastic liner bag, by rotating the lid while closed, to avoid exposing the user to the contents of the storage chamber when the bag is full and must be sealed and removed. The resealable opening approach is exemplified by U.S. Pat. No. 5,125,526 to Sumanis, which discloses a garbage pail in which a bag is secured to a rotaatably mounted holder inside the pail. The top of the bag is fastened in place so that rotation of the holder opens and closes the neck of the bag (by twisting it). When a foot pedal is depressed, a linkage opens the lid and rotates the holder to open the bag. Releasing the foot pedal closes the lid and rotates the holder to close the bag. This device suffers from the same drawback as of conventional containers of exposing the user to the accumulated odors when the lid is open, since the bag is open simultaneously.

In the air lock approach, the container includes a lid that covers a first chamber, a transfer mechanism, and a second chamber for finally receiving the waste. The user opens the lid, deposits the waste into the first chamber, and closes the lid. The user then actuates the transfer mechanism to transfer the waste material from the first chamber into a second chamber. Examples of this approach are disclosed in U.S. Pat. Nos. 1,226,634 to Briese; 1,239,427 to Bunnel & Gates; and 1,265,148 to Warren.

The individual packaging approach is shown in U.S. Pat. No. 4,869,049 to Richards et at., in which a container has an inner storage chamber accessed via a closable lid and an intermediate tubular core. A length of flexible tubing is stored along side the core with a closed end disposed at the lower end of the core. After a diaper is deposited into the tube, the core is rotated, which twists the flexible tube to create a seal above the diaper. To dispose of the next diaper, the user opens the lid and inserts the diaper. Pushing the previous seal downward (which pushes the previous diaper into the storage chamber) then creates a new seal by twisting the tube above the newly deposited diaper. Consequently, the device stores the diapers in a series of individually wrapped packages in the storage chamber—each package being separated from adjacent packages by twists in the tube. Although this system prevents the escape of offensive odors, it requires the use of special tubing and the user to manually prepare the tube for each succeeding diaper that is deposited.

SUMMARY OF THE INVENTION

The drawbacks of the prior art are overcome by the present invention, which provides an odorless container for receiving waste material having a holding chamber and a storage chamber separated by a selectively openable peripheral constrictor that prevents odors from escaping from the storage chamber when waste is deposited into the holding chamber. In a preferred embodiment, the odorless container includes a pail having an open end, a fixed main cover mounted on the open end of the pail, a twist ring rotatably mounted to the under side of the main cover, a bag retainer mounted on the main cover; and a lid pivotally attached to the main cover. The twist ring, main cover, and bag retainer have concentric openings that form a passage for the deposit of waste. A peripheral constrictor has a first end attached to the lower end of the twist ring and a second end attached to the loser end of the main cover. A liner, such as a plastic bag, is placed inside the pail with its open end passing through the passage formed by the openings of the rings and attached to the bag retainer and thus fixed in place. By rotating the twist ring, the peripheral constrictor closes in a manner similar to the aperture of a camera to pinch the neck of the plastic bag closed and thus to seal the storage chamber from the outside environment.

Operation of the container involves opening the lid, depositing the waste into the holding chamber, and closing the lid. The peripheral constrictor is then opened allowing the waste to fall from the holding chamber into the storage chamber. Finally, the peripheral constrictor is closed to prepare the pail for the next deposit of waste. Therefore, odors from the storage chamber are never directly exposed to the outside environment.

The peripheral constrictor can be implemented in many ways. It may consist of a continuous, flexible sleeve, discrete strips or strands of flexible material (which may also be elastic) or solid or articulated rigid members. When the peripheral constrictor is implemented as a continuous flexible sleeve or as multiple strips of sufficient width to overlap, it may be used without a bag or other liner, forming by itself an substantial barrier to the passage of air. If continuous, and formed of an air-impermeable barrier, it may form an odor-proof seal. The peripheral constrictor may operate by movement of one end of the constrictor elements about a longitudinal axis of the constrictor, or by lateral movement of the elements toward each other. The liner used with the peripheral constrictor may be a separate sleeve fixed to the container, which again may obviate the need for a bag.

DETAILED DESCRIPTION

Figure 1A:
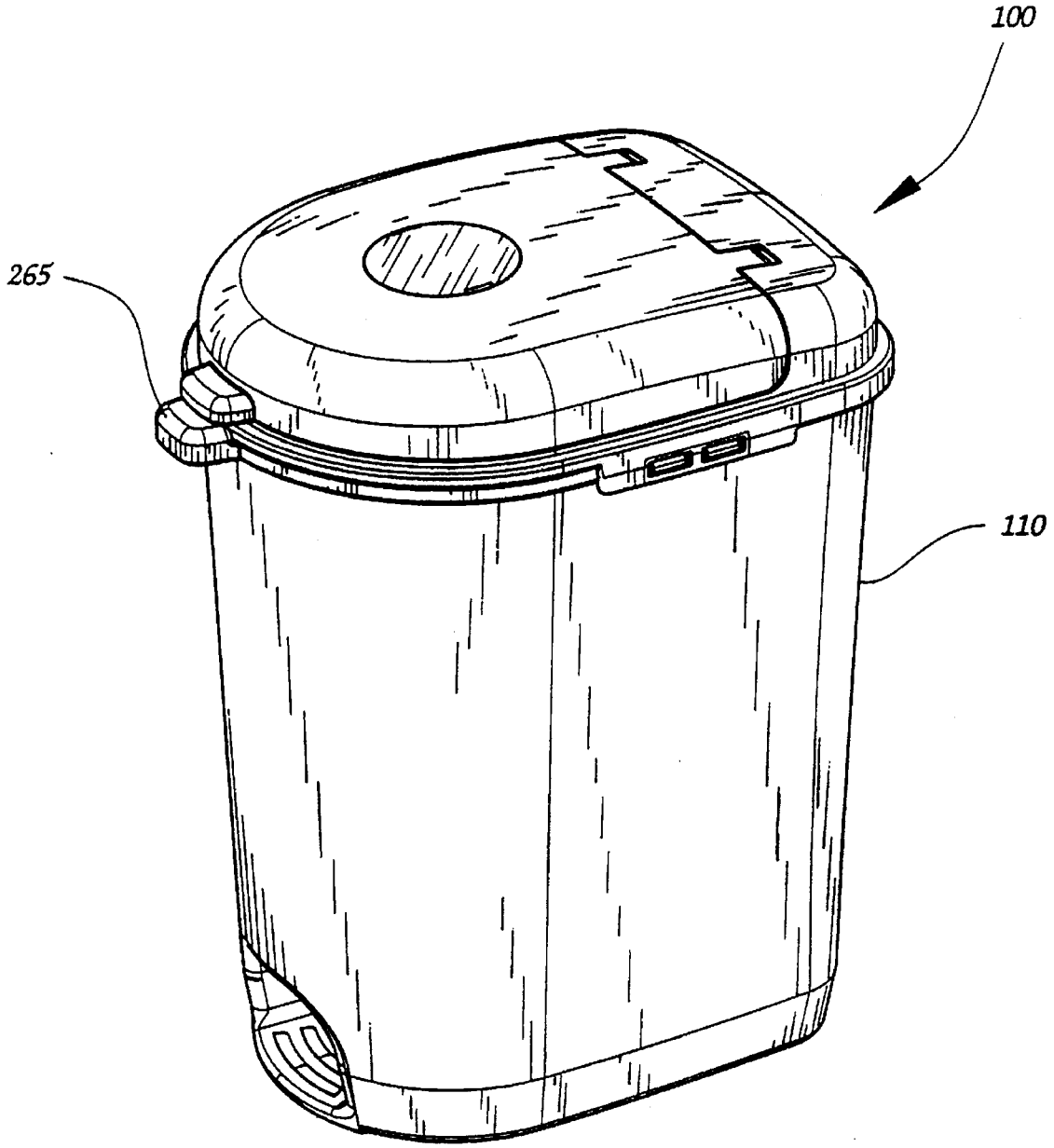
FIGS. 1A–D are front and rear perspective views, rear elevation, and top plan views of a first embodiment of an odorless container employing the principles of the present invention
Figure 1B:
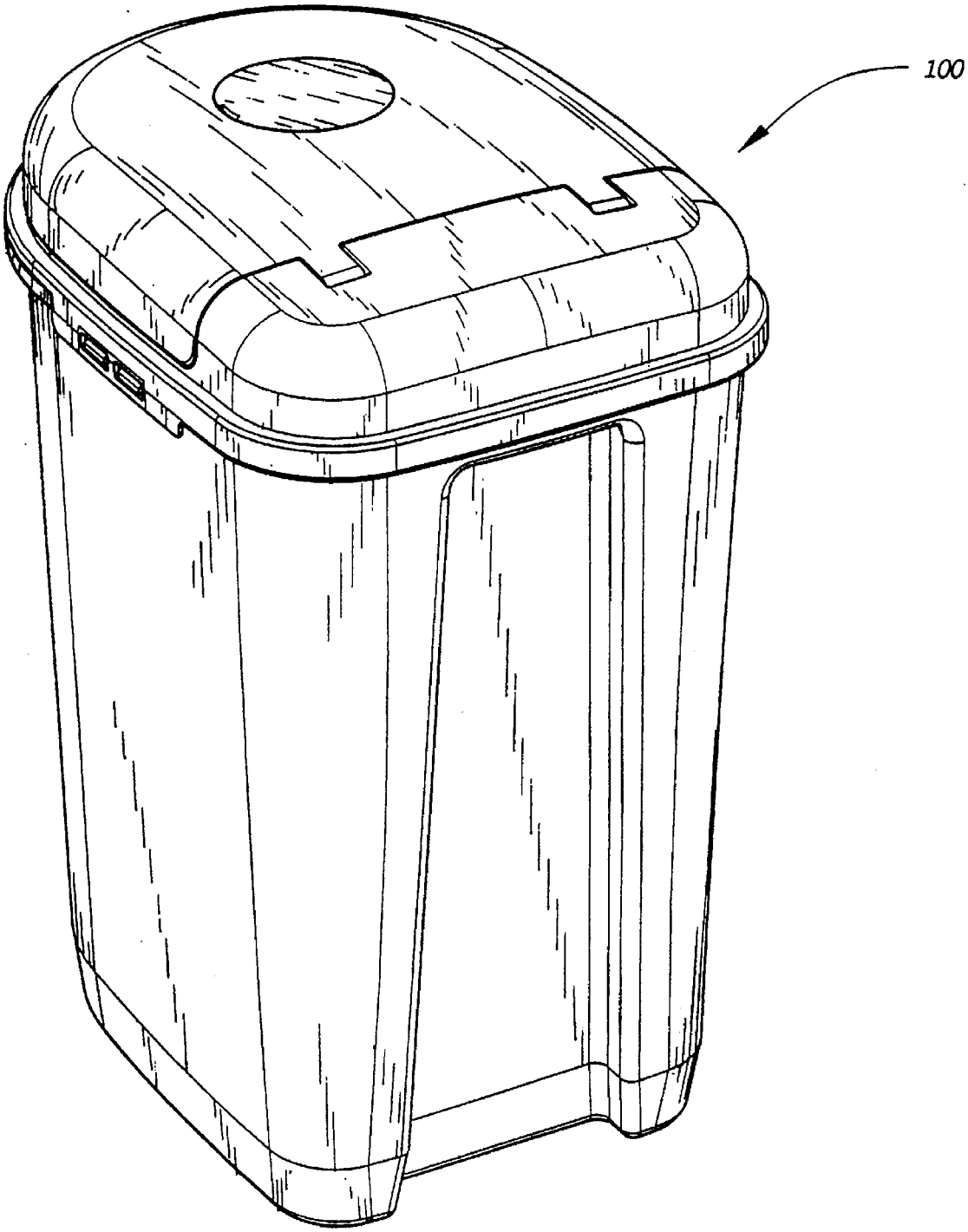
Figure 1C:
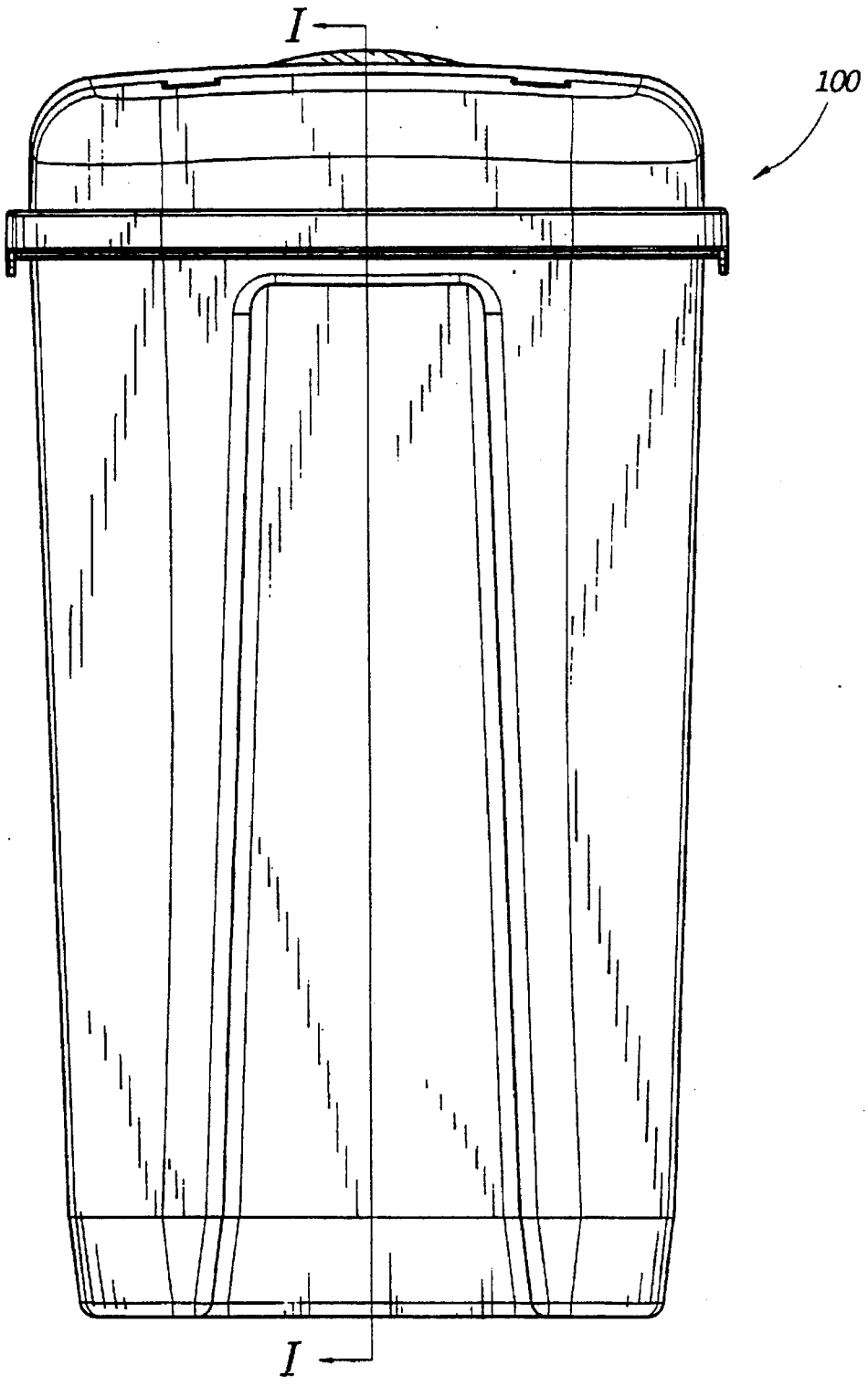

The invention is described and illustrated below in the context of a diaper disposal pail. However, the dimensions and design of the odorless container may be modified to accommodate any waste material having unpleasant or hazardous odors, fumes, hazardous bacteria, or other airborne matter. Other such applications of this invention would include use in a trash can, a medical waste receptacle, and a chemical waste receptacle.

As shown in FIGS. 1A–E and 2, odorless container 100 includes a pail 110, a main cover 200 seated on the open end 122 of pail 110, a lid assembly 130 hinged to main cover 200, a bag retainer 150, a twist ring 250 nested under main cover 200, and a peripheral constrictor, implemented in this embodiment as flexible sleeve 300 (shown in FIG. 9A) attached to twist ring 250 and main cover 200.

Pail 110, which is shown in FIGS. 3A–D, has a generally flat bottom wall 120 and upward depending generally planar rear, left, and right side walls 112, 114, 116 respectively, and semi-cylindrical front wall 118. The bottom and upstanding walls define a storage chamber 600 with an open end 122. The upper ends of the upstanding walls terminate in a flat beaded rim 123, with the upper end of front wall 118 forming a semicircular front portion 124 of rim 123, which is separated from left side portion 127 and right side portion 128 of rim 123 by left and right flange grooves 125 and 126 while rear portion 129 of rim 123 extends across rear wall 112. A foot recess 111, is formed at the bottom end of front wall 118, and a hand grip recess 113 is formed at the upper end of rear wall 112. Left and right engagement tabs 115, 119 extend outward from the upper portions of left and right side walls 114, 116, respectively.

As shown in FIGS. 4A–D, main cover 200 has a generally annular body portion 205, with a stepped cylindrical tube 206 depending downwardly from its inner periphery, and a stepped cover rim 207 depending downwardly from its outer periphery. Body portion 205 also includes an upper lid hinge portion 210 and a lid shoulder 211 extending about the cover body from lid hinge portion 210. Lid hinge portion 210 includes left and right ring lid hinge recesses 212 and 213. Stepped cylindrical tube 206 defines a cover waste passage 215, and has an upper portion 216 terminating at its lower end in an upper radially-inwardly projecting annular retainer ring support shoulder 217. A twist ring support portion 220 depends downwardly from the inner periphery of upper shoulder 217, and includes several beveled rim support tabs 221 projecting outwardly from its outer surface and a lower shoulder 225 projecting radially inwardly from its lower end. Finally, inner sleeve support portion 230 depends downwardly from the inner periphery of lower shoulder 225, and includes several inner sleeve support posts 235 projecting radially outwardly from its outer surface.

Stepped cover rim 207 includes a front portion 240 and a rear portion 241 corresponding generally to front and rear portions 124, 129, of beaded pail rim 123. Support ribs 242 extend downward from under the sides and rear portion 241 of stepped cover rim 207 to rest on pail rim 123. Left cover bracket 244 and right cover bracket (not shown) depend downwardly from stepped rim cover 207 so that left bracket apertures 295 receive left engagement tabs 115 of pail 110 and right bracket apertures (not shown) receive right engagement tabs 119 of pail 110 to retain main cover 200 on pail 110. Cover rim front portion 240 is spaced from pail rim front portion 124 to accommodate twist ring 250 therebetween. Cover rim front portion 240 also includes a lid latch 246 with aperture 247 and latch finger 248.

Figure 5A:
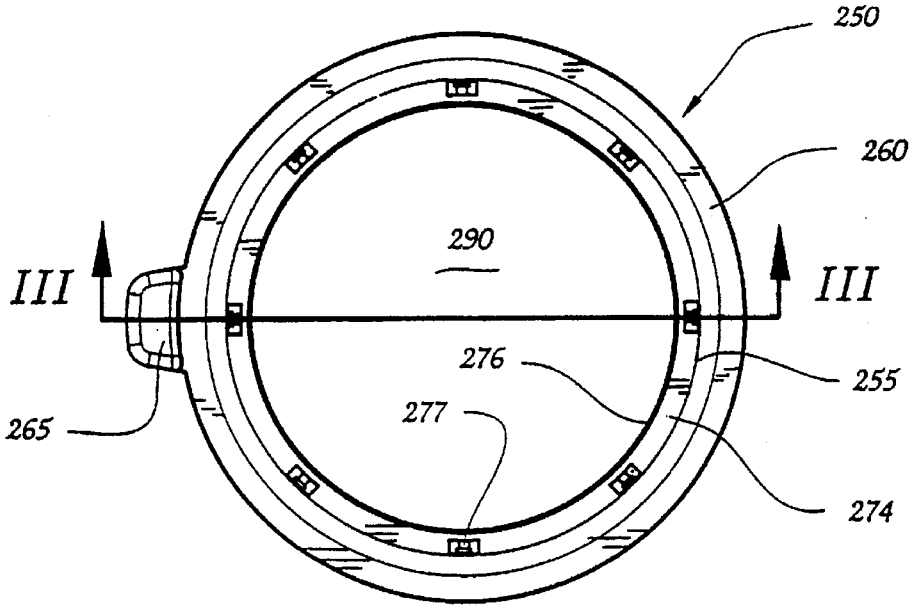
FIGS. 5A and B are top and front views of the twist ring of the odorless container of FIG. 1
Figure 5B:
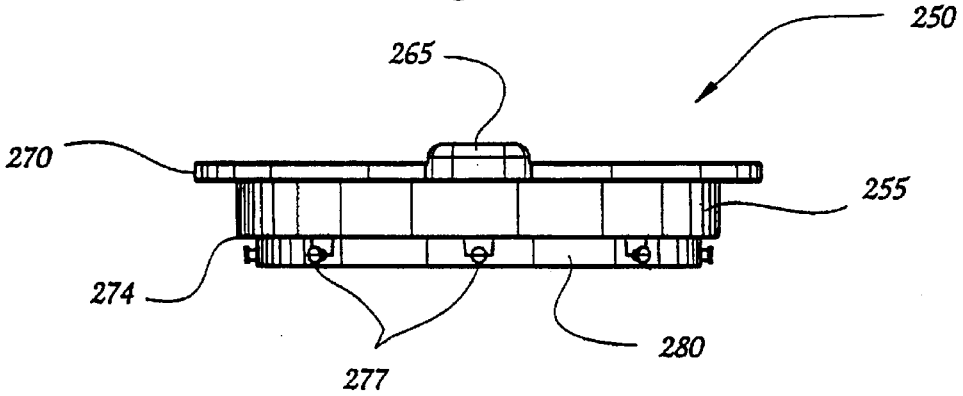
FIG. 5C is a cross-sectional view taken along line III—III in FIG. 5A.
Figure 5C:
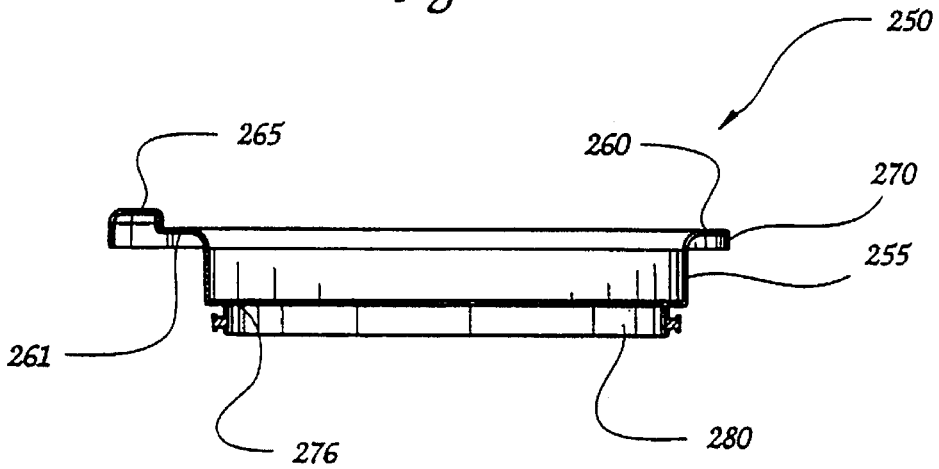

Twist ring 250, shown in FIGS. 5A–C, has a generally cylindrical body portion 255 with a generally horizontal upper rim 260 extending radially outwardly from the upper end of body portion 255 and including a downwardly depending flange 270 extending around nearly the entire perimeter of rim 260 except for the portion of rim 260 from which handle 265 extends. Body portion 255 terminates in radially inwardly projecting shoulder 274. Sleeve retaining rim 280 depends downwardly from the inner perimeter of shoulder 274 and includes outwardly projecting posts 277 equally spaced around the perimeter. Inwardly projecting support lip 276 extends inward from the junction of shoulder 274 and rim 280. Sleeve retaining rim 280 and cylindrical body portion 255 define a waste passage 290, therethrough.

Figure 1D:
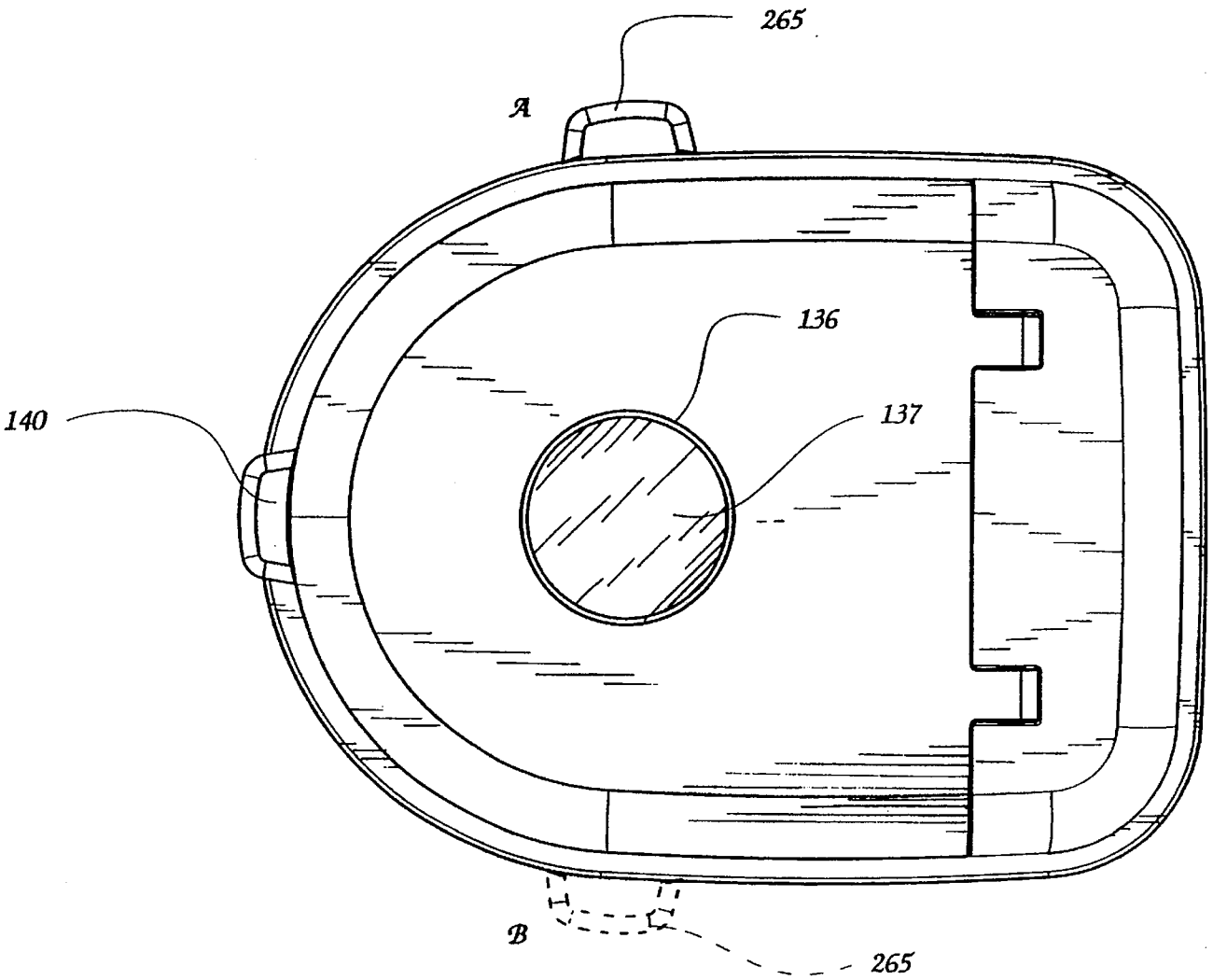
Figure 1E:
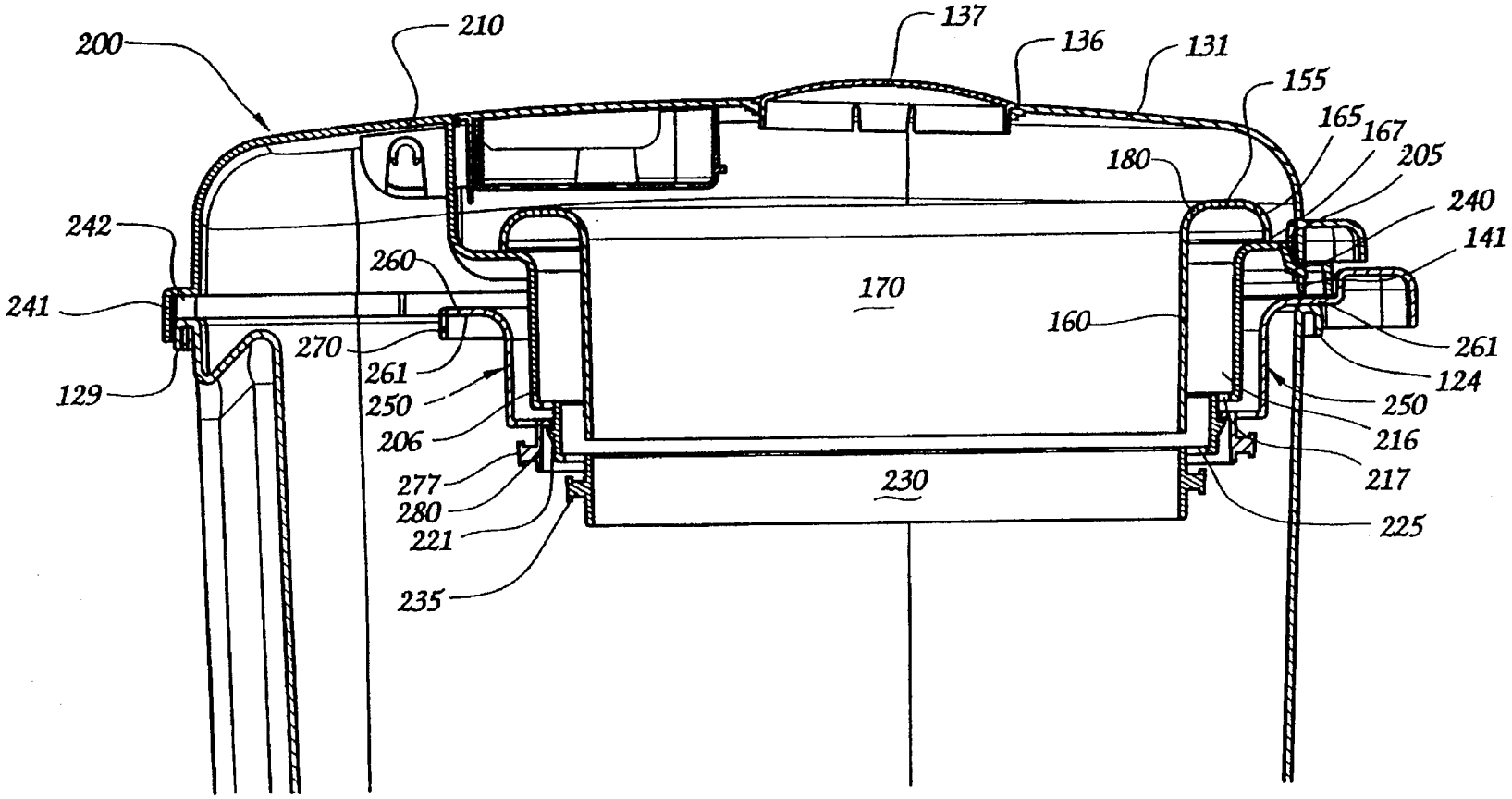
FIG. 1E is a partial cross-sectional view of the odorless container taken along line I—I in FIG. 1C.
Figure 2:
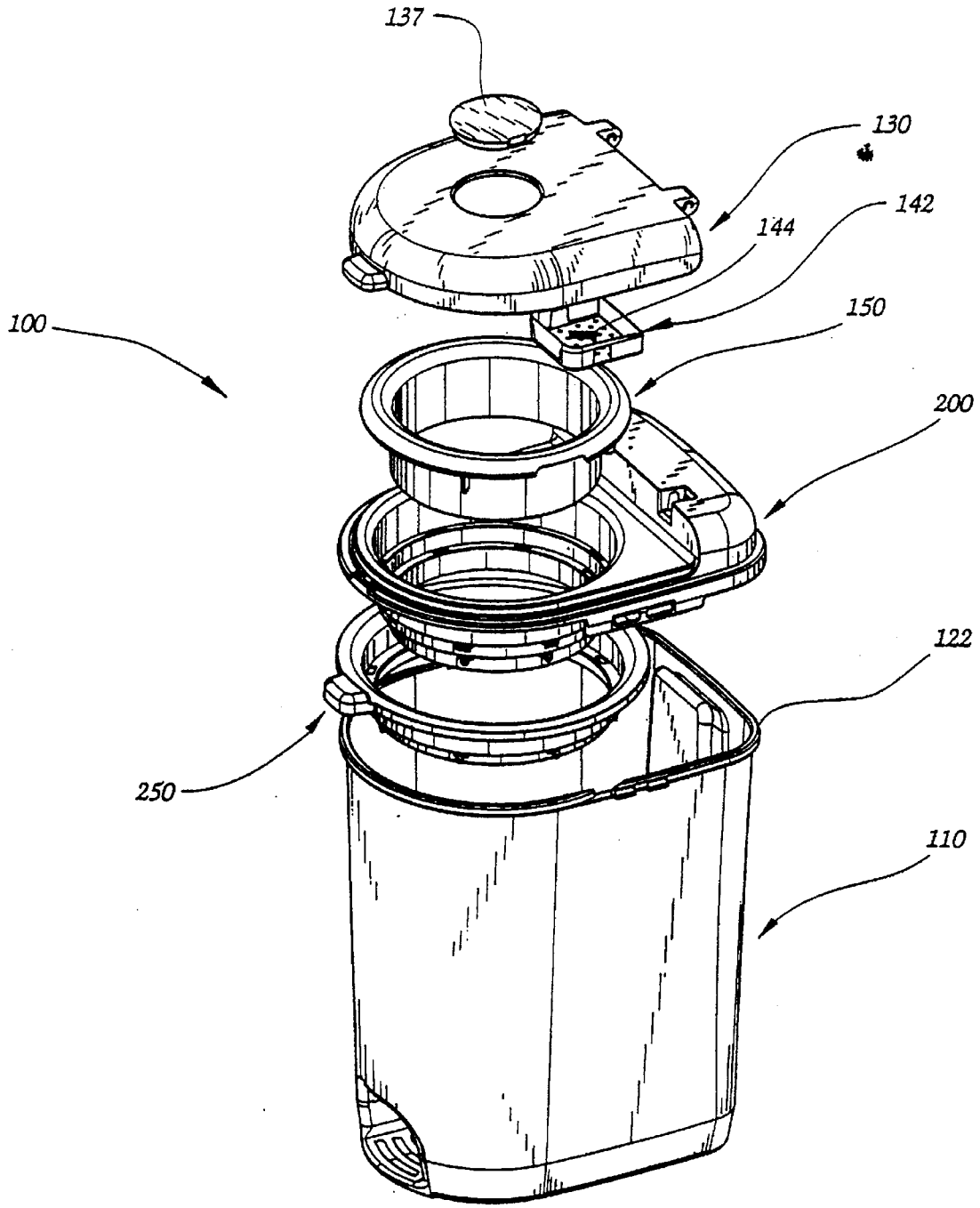
FIG. 2 is an exploded perspective view of the odorless container of FIG. 1.
Figure 3A:
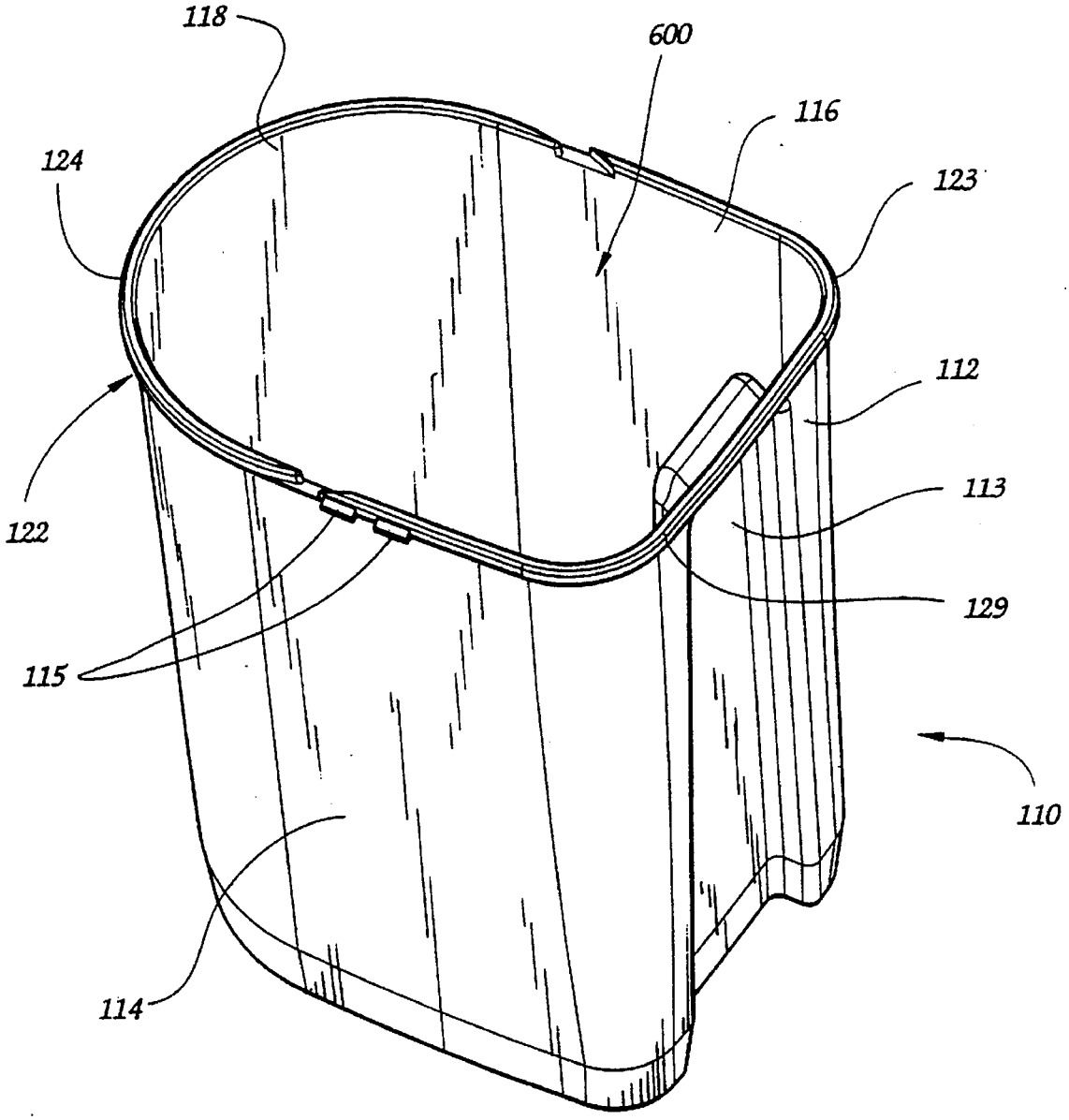
FIGS. 3A–C are perspective, top and bottom views of the pail of the odorless container of FIG. 1
Figure 3B:
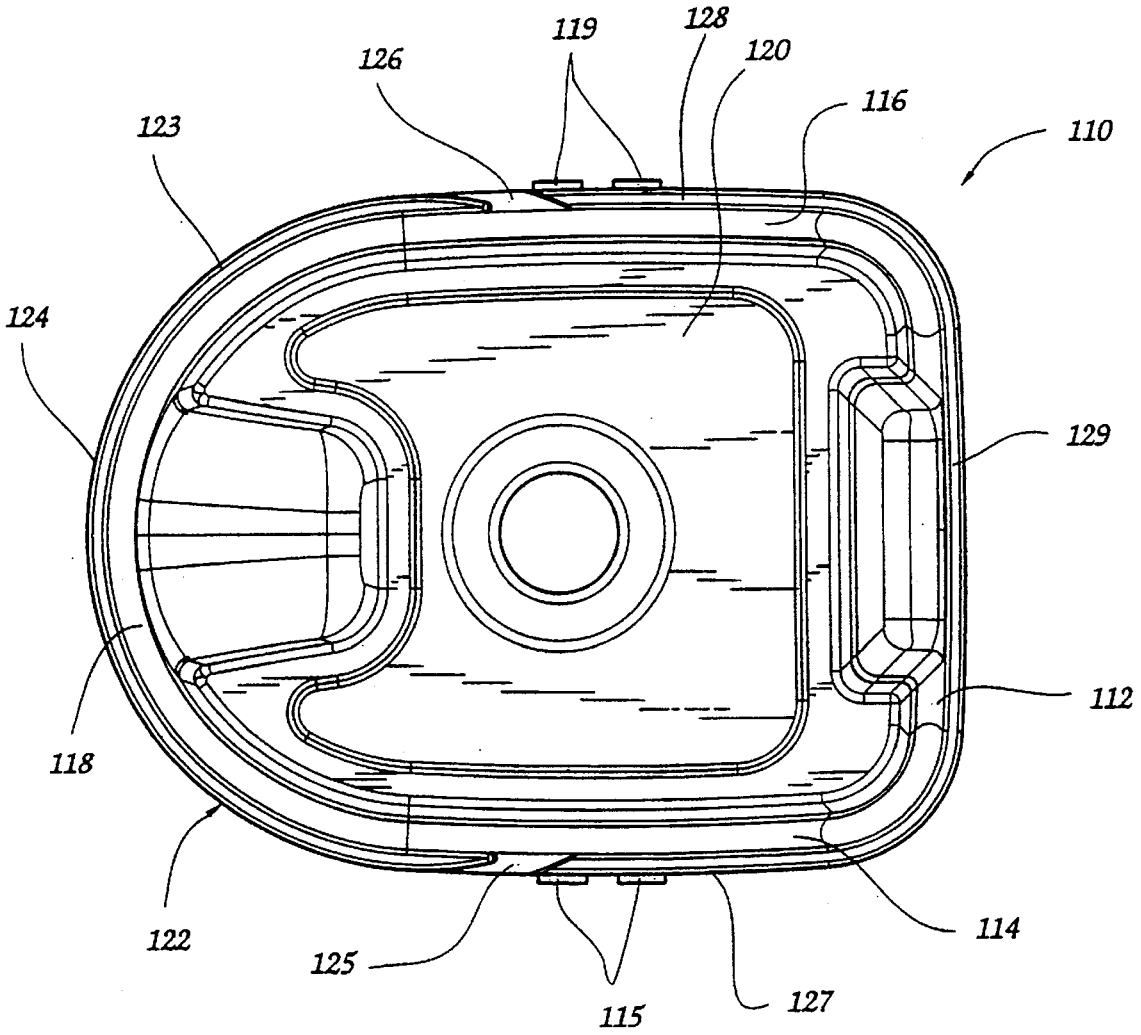
Figure 3C:
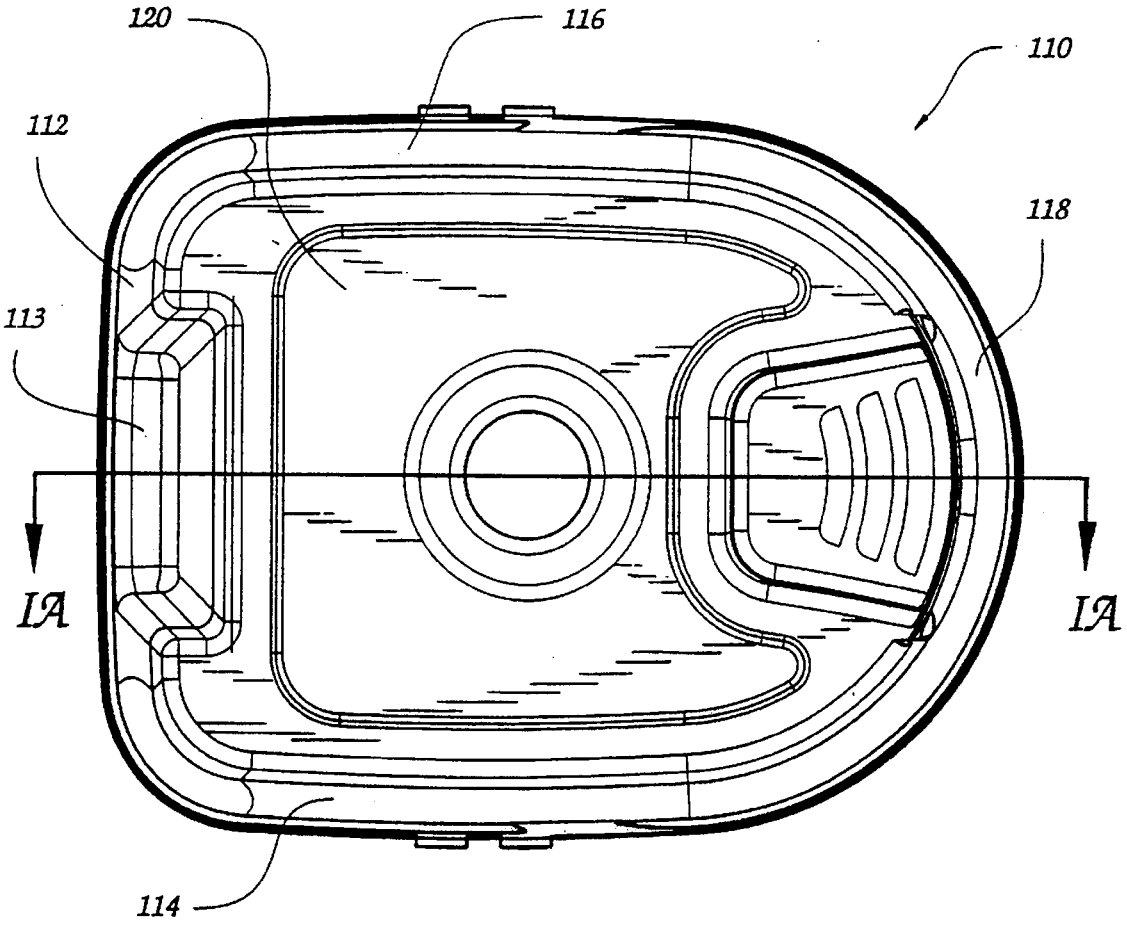
Figure 3D:
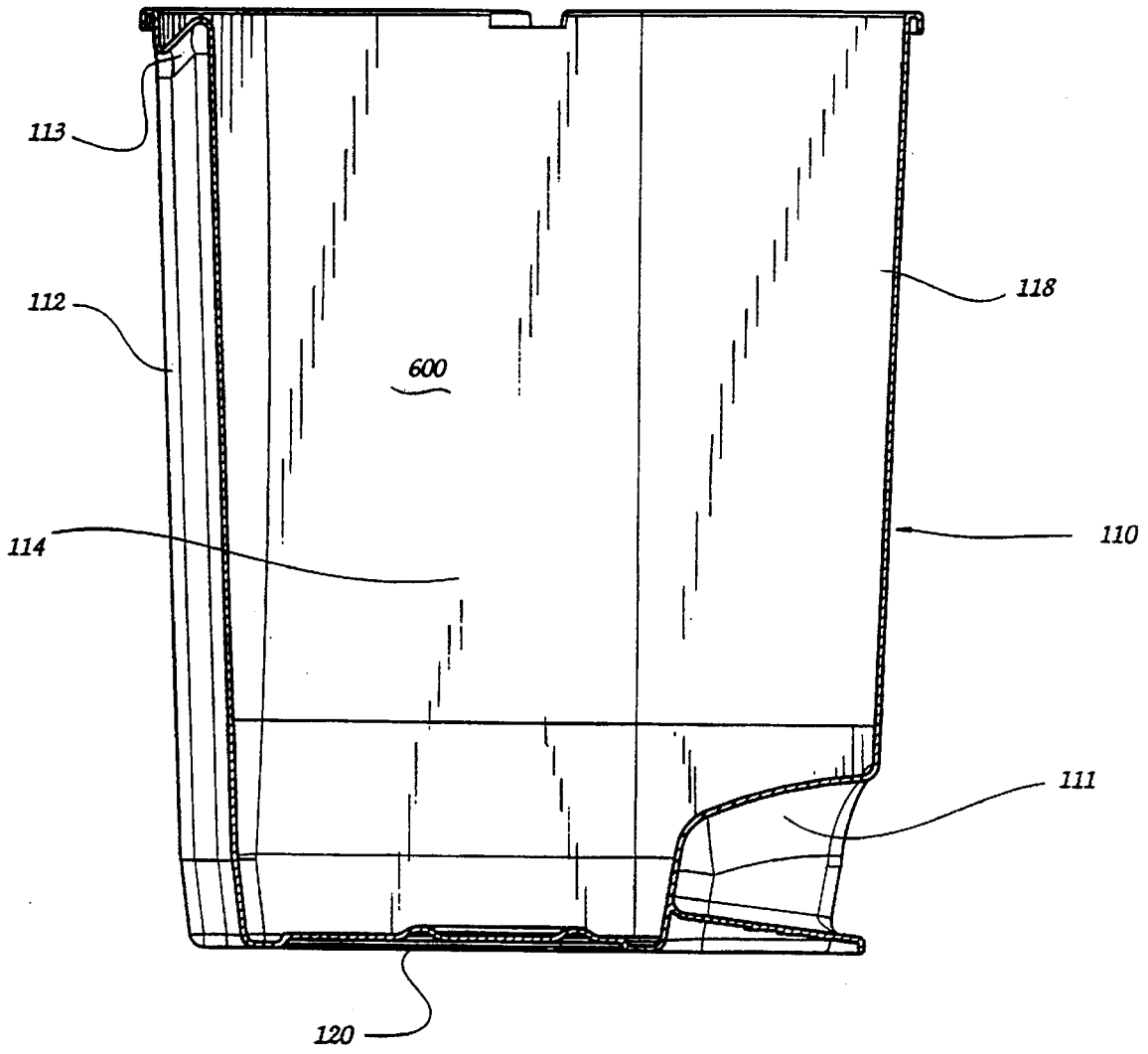
FIG. 3D is cross-sectional view of the pail taken along line IA—IA in FIG. 3C.
Figure 4A:
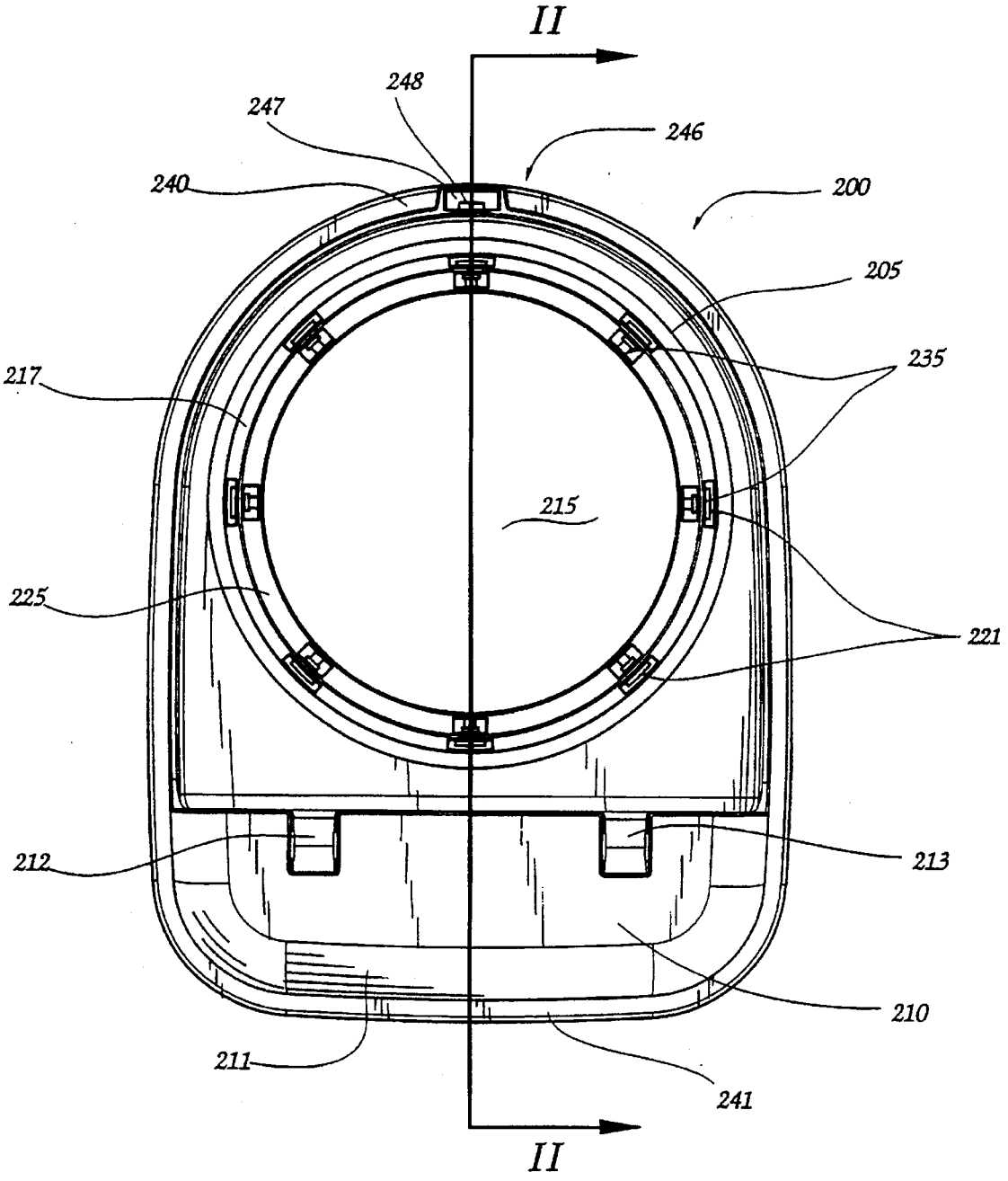
FIGS. 4A–C are top and bottom plan, and side elevation views, respectively, the main cover of the odorless container of FIG. 1.
Figure 4B:
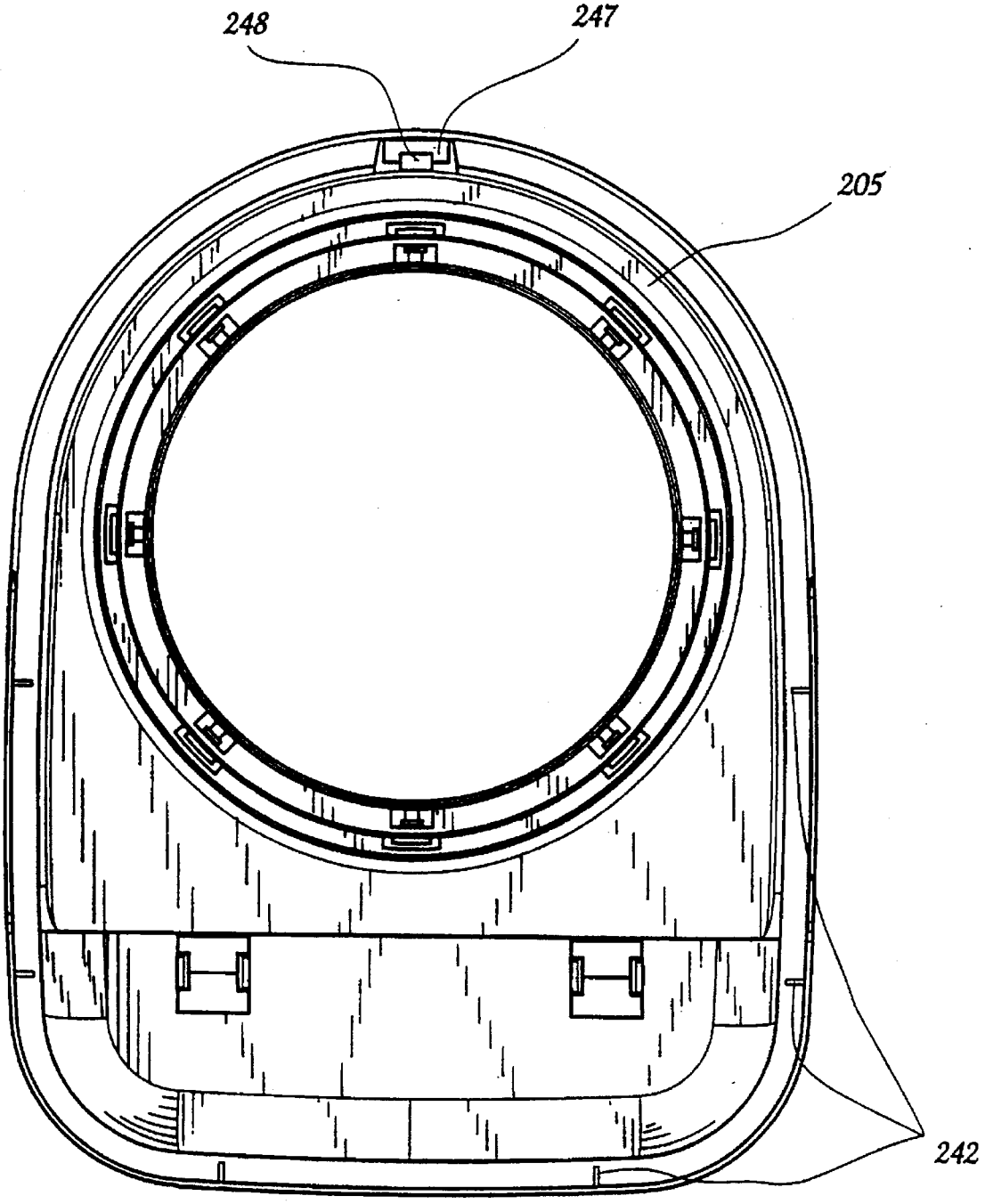
Figure 4C:
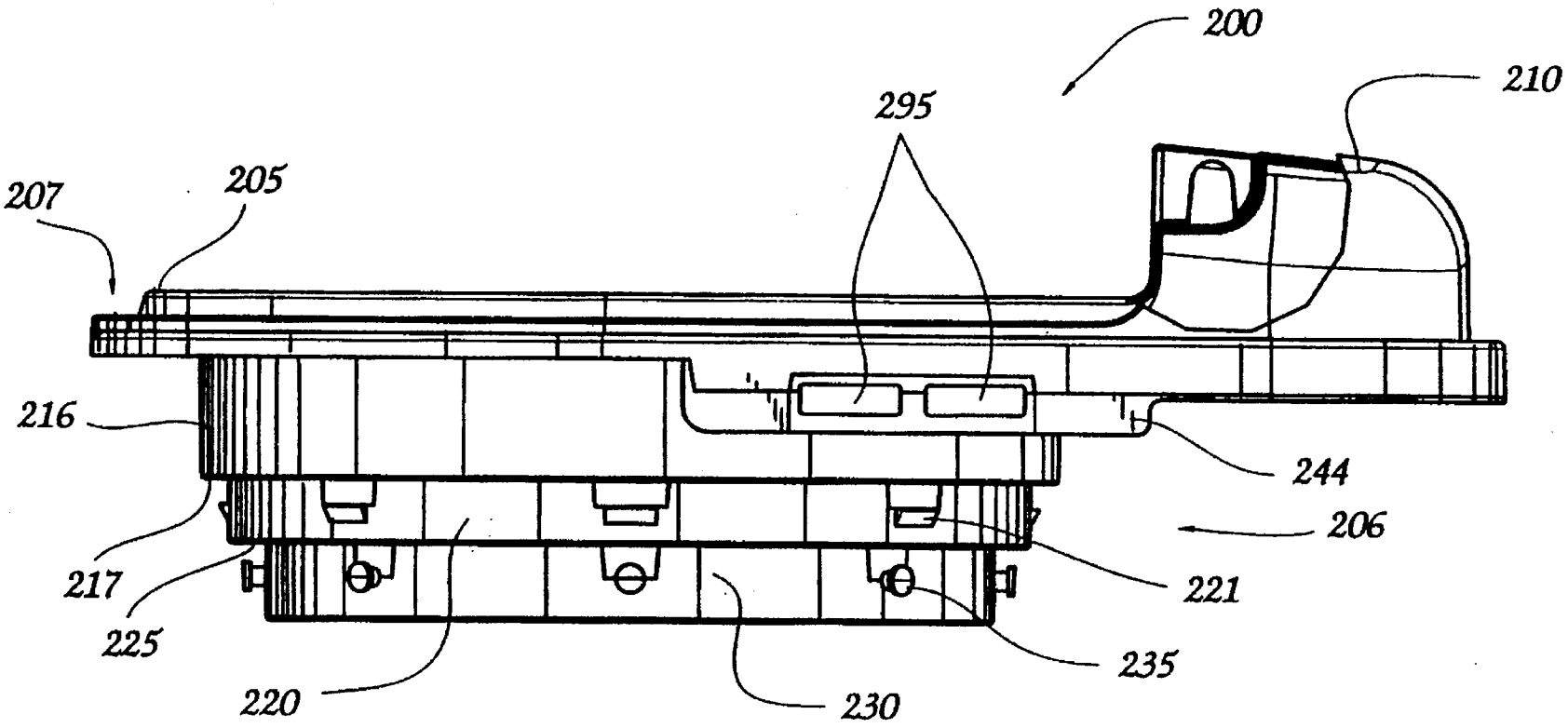
Figure 4D:
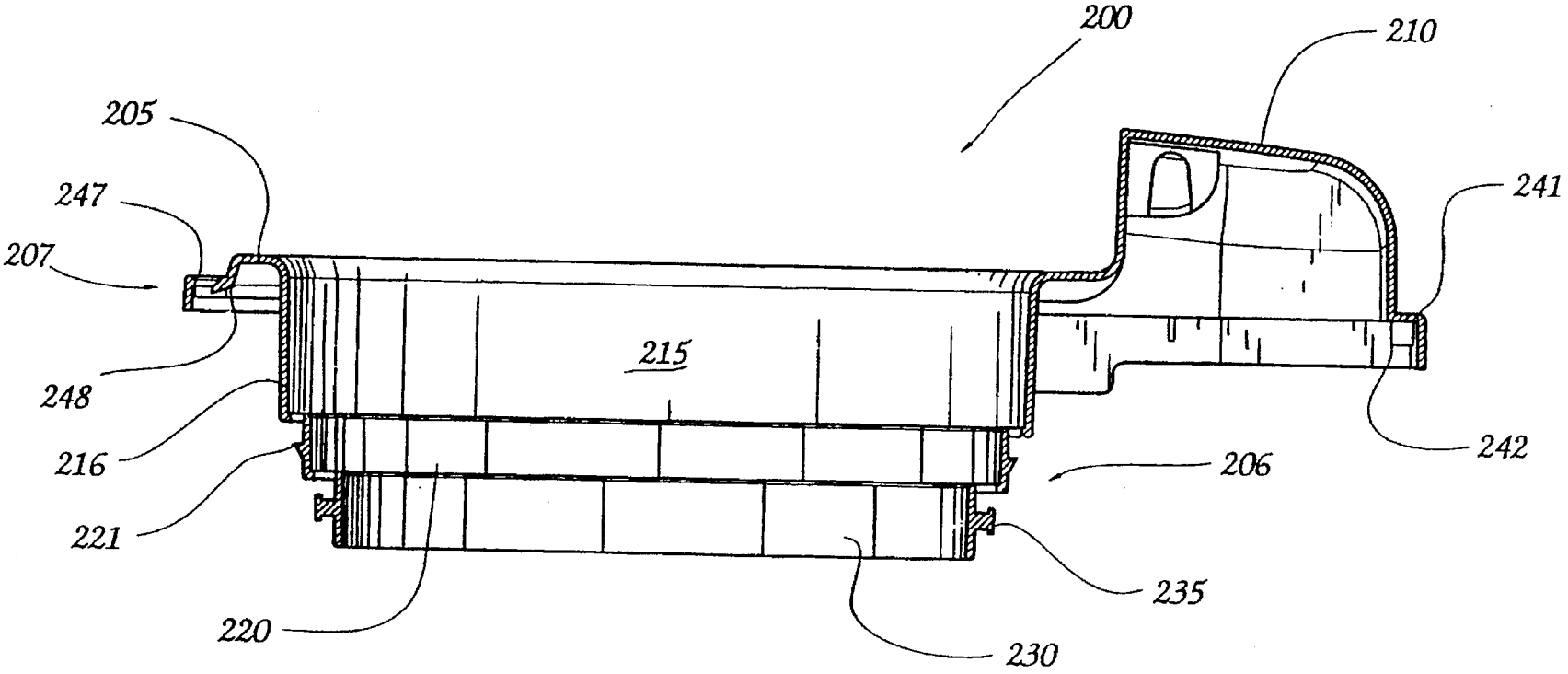
FIG. 4D is a cross-sectional view taken along line II—II in FIG. 4A.

Twist ring 250 is mounted to the under side of main cover 200 and rides above open end 122 of pail 110, with lower surface 261 of rim 260 disposed on the upper surface of beaded rim 123 of pail 110. Flange 270 extends into flange grooves 125 and 126. Twist ring 250 is supported under support lip 276 by beveled tabs 221 of twist ring support portion 220 of main cover 200. Referring to FIG. 1D, handle 265, twist ring 250 can be rotated by handle 265 between a closed position (indicated by letter A) and an open position (shown in phantom and indicated by letter B).

Figure 6A:
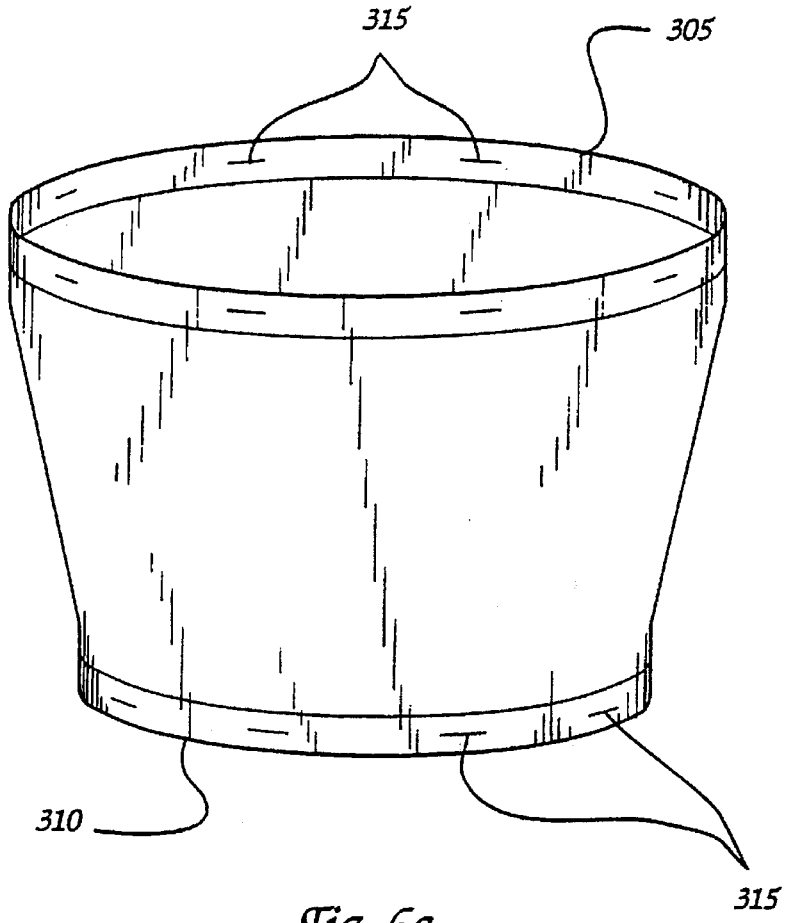
FIGS. 6A and B are side views of the flexible sleeve of the odorless container of FIG. 1 in the extended and folded states, respectively.
Figure 6B:
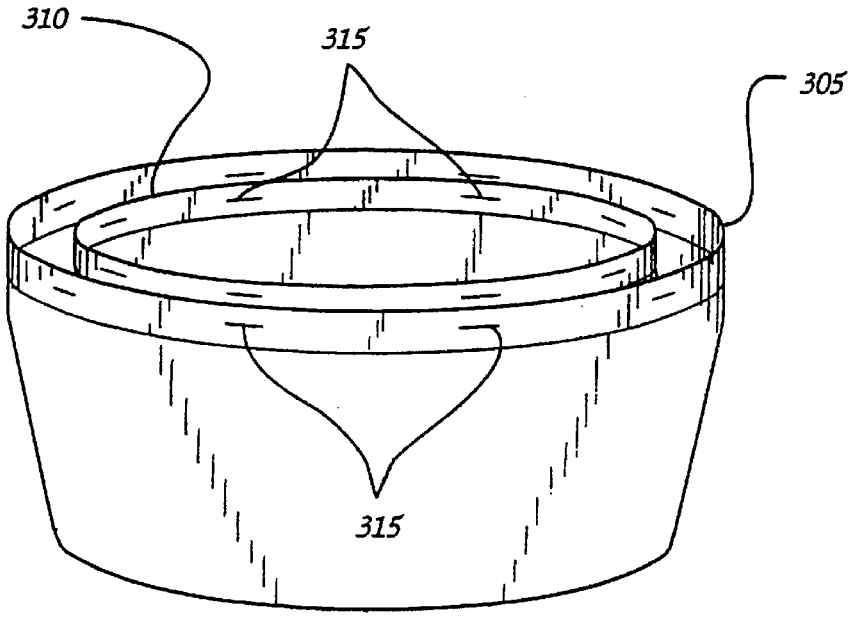

As shown in FIGS. 6A and B, flexible sleeve 300 has first and second open ends 305, 310, respectively and has a generally conical shaped body when unassembled. Both first and second ends 305 and 310 include mounting holes 315 that attach to posts 277, 235 of sleeve mounting rim 280 and inner sleeve support portion 230, respectively. In the present embodiment, flexible sleeve 300 is made from 70 denier nylon fabric, but any suitable material would suffice depending on the nature of the application (i.e., the tightness of the seal needed and the waste material to be stored). However, the material must be sufficiently flexible to allow the rotation of twist ring 250 so that flexible sleeve 300 pinches off the plastic bag. In addition, in the present embodiment the flexible sleeve is removable and washable.

Figure 7A:
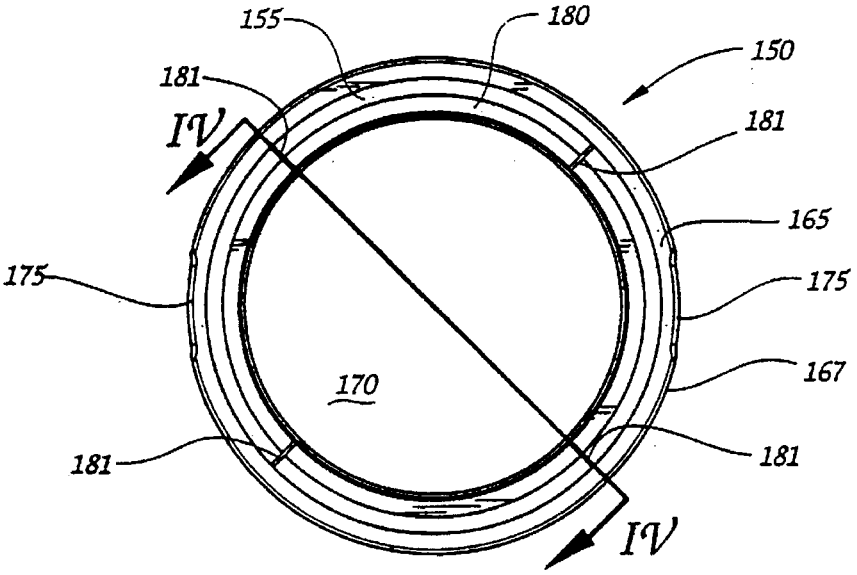
FIGS. 7A and B are bottom and side elevations of the bag retainer of the odorless container of FIG. 1
Figure 7B:
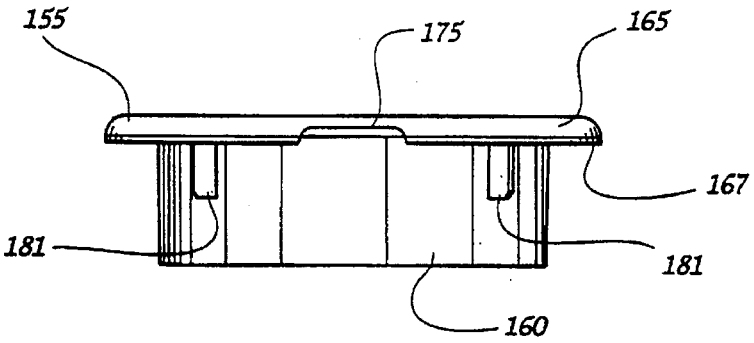
FIG. 7C is a cross-sectional view taken along line IV—IV.
Figure 7C:
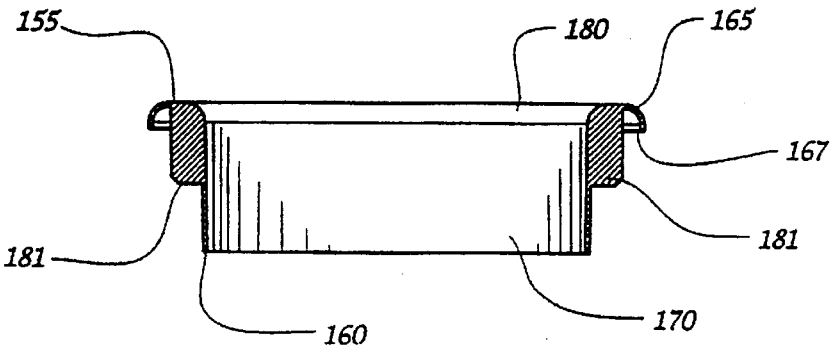
Figure 8A:
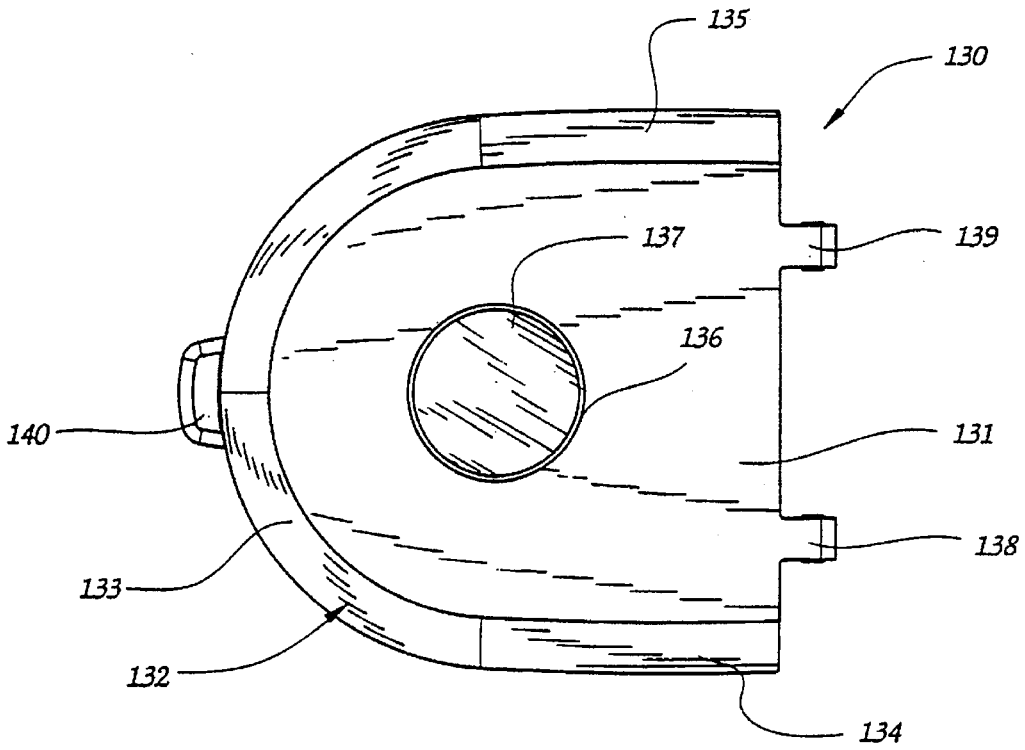
FIG. 8A–E are top, and bottom plan, and front, rear, and side elevation views, respectively of the lid assembly of the odorless container of FIG. 1.
Figure 8E:
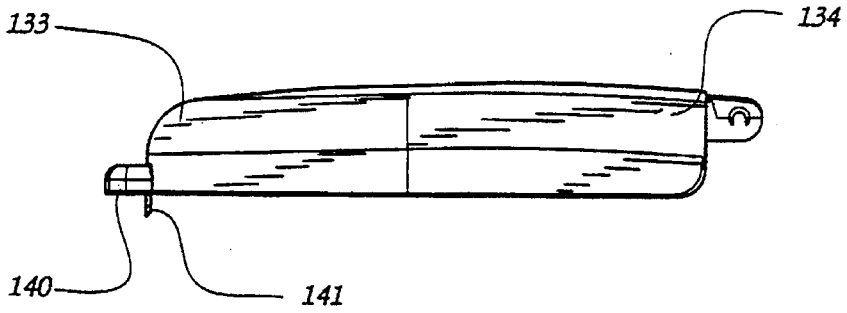
Figure 8C:
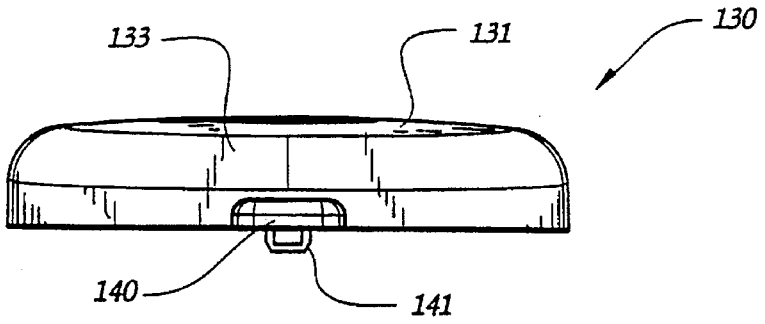
Figure 8D:
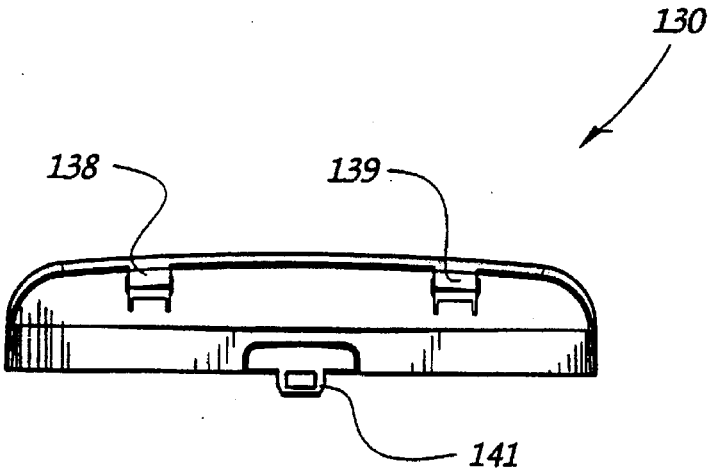
Figure 8B:
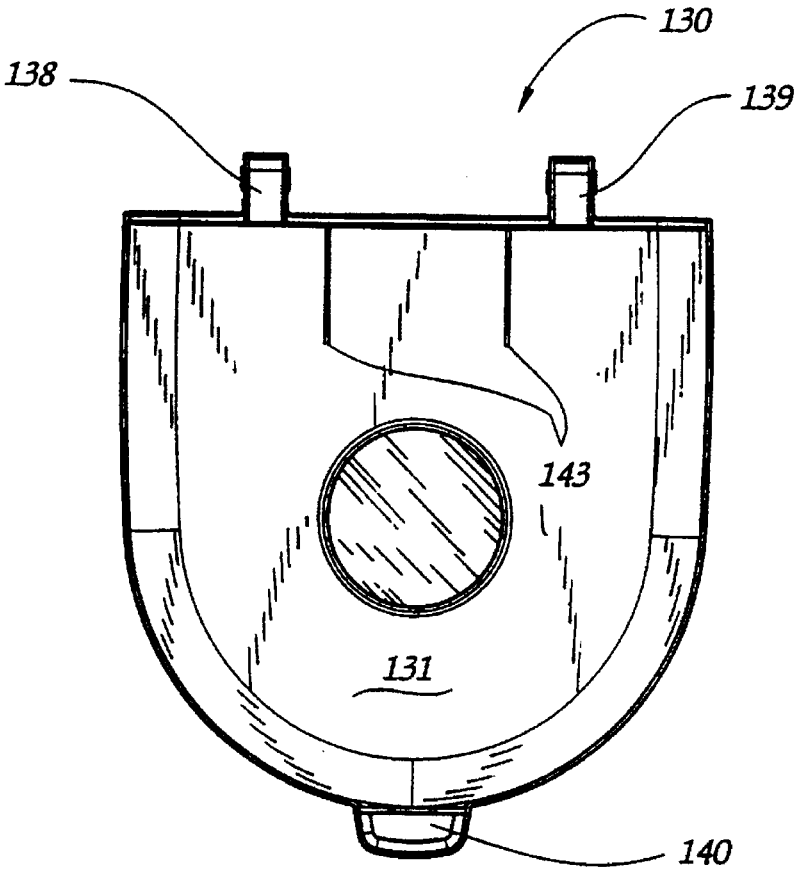

As shown in FIGS. 7A–C, bag retainer 150 has an annular body portion 155 having an inner shoulder 180, which has a waste tube 160 depending down therefrom, which forms a bag aperture 170, and a downwardly depending outer rim 165 extending around nearly the entire perimeter except for the two portions where handles 175 are formed to allow for easy removal. Outer rim 165 terminates in a lip 167 which, when assembled, rests on main cover 200 to hold bag retainer 150 in place. Four vertical webs 181 are formed between waste tube 160, shoulder 180 and body portion 155 and create a snug fit with upper portion 216 of main cover 200.

Lid assembly 130, which is shown in FIGS. 8A–E, includes a body portion 131 which has a downwardly depending rim 132 which includes a front side portion 133, a left side portion 134, and a right side portion 135 that seal against main cover 200. Front side portion 133 of body portion 131 includes a handle 140 and a flexible lid latch 141 which engages lid latch 246 of main cover 200 to hold lid assembly 130 in the closed position. Body portion 131 also includes an aperture 136 and left and right hinges 138, 139, respectively, which pivotally engage left and right hinge recesses 212, 213 of main cover 200 and allow lid assembly to pivot between an open and closed position. Odor absorber assembly 142, shown in FIG. 2, includes absorber 144 (such as shown in U.S. Pat. No. 5,174,462, the disclosure of which is incorporated herein by reference) and is mounted to the underside of lid assembly 130 between ribs 143. Window 137 is mounted in aperture 136 to allow the user to view the contents of container 100 when lid assembly is in the closed position.

Figure 9A:
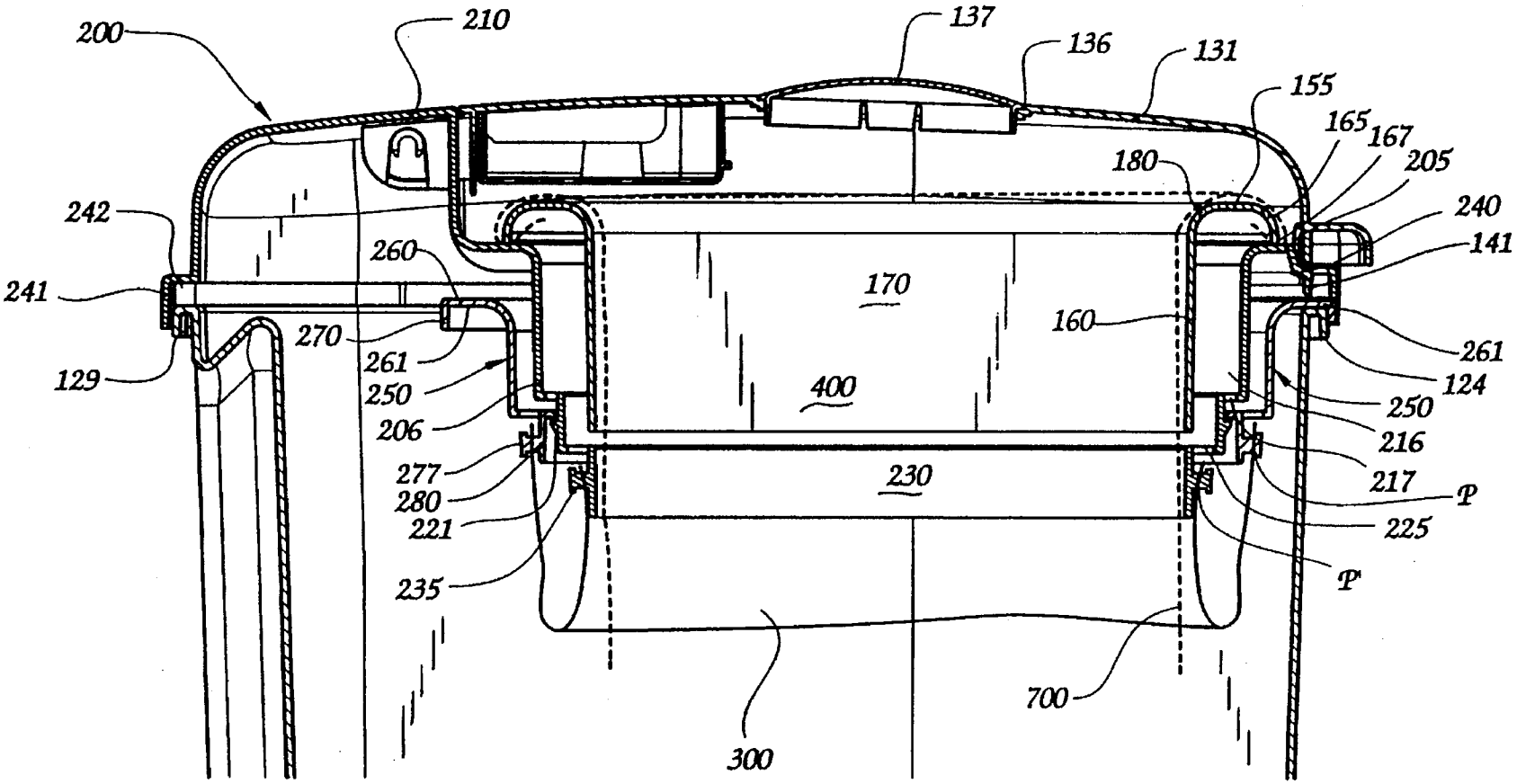
FIGS. 9A and B are partial cross-sectional views of the odorless container of FIG. 1C taken along line I—I with the flexible sleeve in the open and closed positions, respectively.
Figure 96:
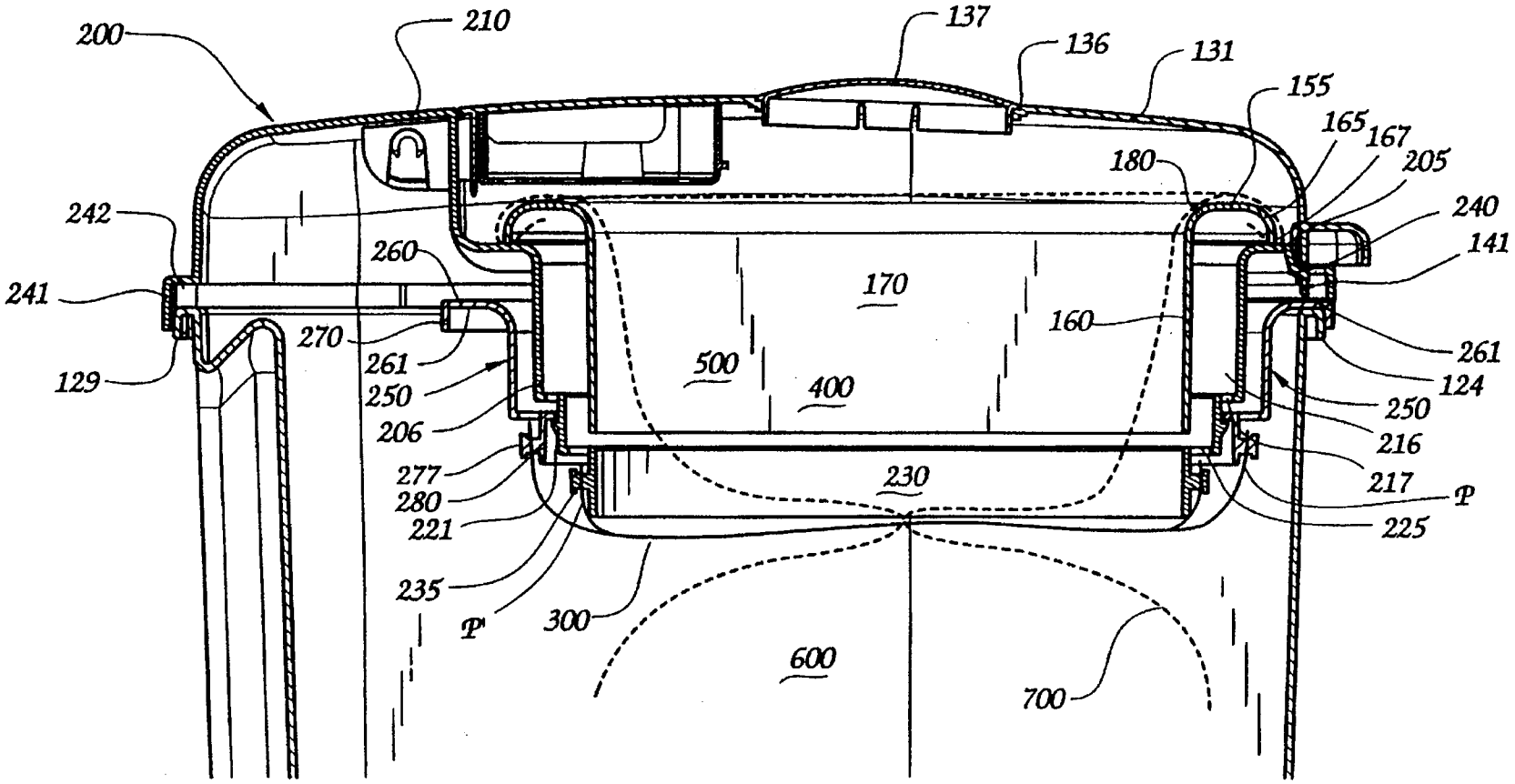

When assembled as shown in FIG. 9A, lid assembly 130, bag retainer 150, main cover 200, and twist ring 250, and flexible sleeve 300 form a cover assembly and are positioned so that the openings of bag retainer, main cover 200, and twist ring 250—bag aperture 170, waste passage 215, and waste aperture 290, respectively—define waste passage 400 which extends from body portion 155 of bag retainer 150 through sleeve support portion 230 of main cover 200. In addition, in this embodiment sleeve support portion 230 and sleeve retaining rim 280 are substantially (but not completely) coplanar, which provides vertical compactness, but also allows for easy removal of flexible sleeve 300 for washing (i.e., twist ring 250 may remain mounted to main cover 200 when removing and attaching flexible sleeve 300). However, the invention would also work well if sleeve support portion 230 and sleeve retaining rim 280 were not substantially coplanar, but vertically displaced from each other.

PERIPHERAL CONSTRICTOR

Before discussing the operation of odorless container 100, it is helpful to describe the theory and operation of the peripheral constrictor. The peripheral constrictor has been illustrated above in the first embodiment as flexible sleeve 300. However, the peripheral constrictor can be implemented in many ways. Most broadly, the constrictor can be viewed as a mechanism for selectively controlling the perimeter of a passage through the constrictor. In a fully open position, the constrictor allows the passage to assume a maximum peripheral extent, while in a closed position, the peripheral extent of the passage is closed to a minimum, preferably zero peripheral extent. The passage will normally be lined by a liner (such as a bag) so that movement of the constrictor to the closed position will pinch the liner's sidewall together to completely close the passage.

The liner is preferably formed of a material that is air-impermeable, and therefore provides a barrier to airborne odors, etc. Although the liner is preferably a bag that also lines the interior of the pail, it may alternatively be configured as an open sleeve associated with the constrictor. This liner may then be supplemented with a bag if desired. As described in more detail below, the liner may also be eliminated if the constrictor is implemented as a continuous sleeve formed of an air-impermeable material.

Figure 10A:
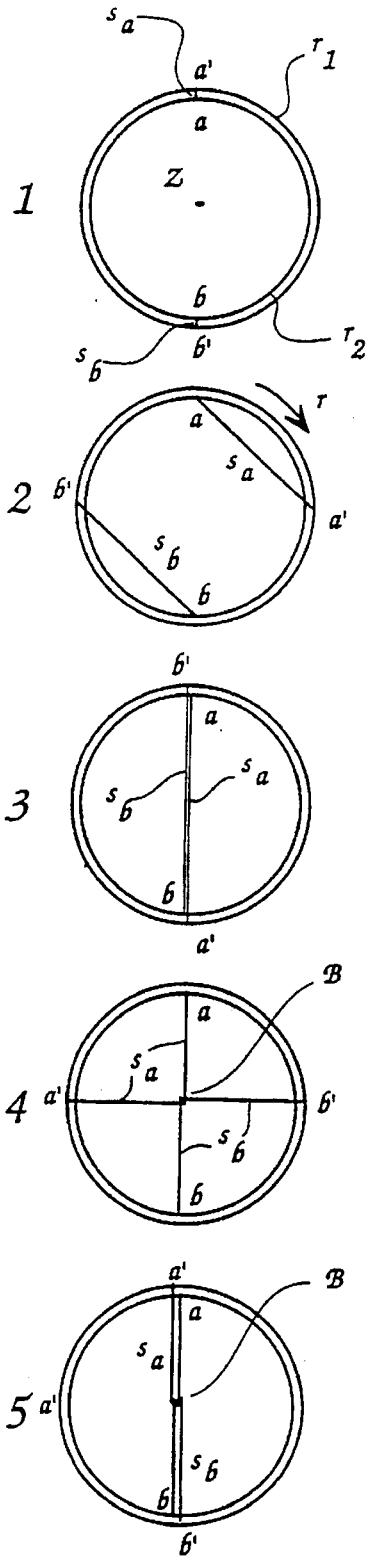
FIG. 10A is a schematic top view.
Figure 10B:
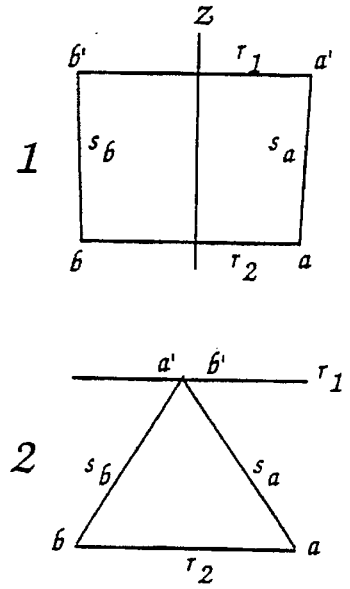
FIGS. 10B–C are schematic side elevations, of two alternative embodiments of a peripheral constrictor with two constrictor elements.
Figure 10C:
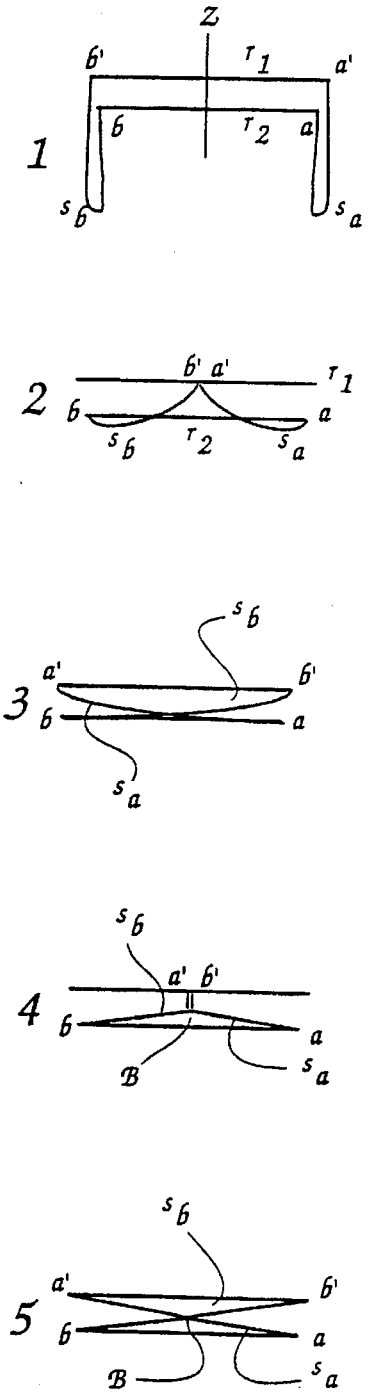

The operation of the constrictor is illustrated in FIGS. 10A–C for two variants of the simplest embodiment of the constrictor, having two constrictor elements. For simplicity, these elements can be considered as strings or strands, $s_a$ and $s_b$. Each strand $s_a$, $s_b$ is connected at one end (a and b, respectively) to a fixed ring $r_2$ (such as inner sleeve support portion 230) and at the other end (a' and b', respectively) to a movable ring $r_1$ (such as sleeve mounting rim 280). In FIGS. 10A–C, the positions of the strands are shown in varying angular positions (identified as positions 1 through 5) of movable ring $r_1$ as it is rotated in the direction of arrow r with respect to fixed ring $r_2$ about the longitudinal axis Z of the constrictor.

In FIG. 10B, the rings are separated by a substantial distance relative to the diameters of the rings, while in FIG. 10C, they are much closer (as in the first embodiment described above). As illustrated in FIG. 10B, the strands are stretched taut between the rings throughout the range of motion of the movable ring, while the vertical spacing of the rings is fixed—the strands must therefore be elastic. In contrast, the strands in FIG. 10C are inelastic, and therefore droop until pulled taught by the motion of the movable ring. The top view shown in FIG. 10A is the same for both embodiments.

In position 1, the two ends of each strand are at the same angular position with respect to axis Z. In position two, movable ring $r_1$ has been rotated 90° with respect to fixed ring $r_2$. The perimeter of the area bounded by the strands has thus been diminished. In position 3, ring $r_1$ has been rotated an additional 90°, for a total of 180°, further reducing the perimeter. The strands are now crossed and just touching. Further rotation of ring $r_1$ causes the strands to wrap around each other at a bight B. The perimeter within the bight B is zero. Thus, once the bight has been formed, the constrictor can be considered to be in a "closed" position, having reduced the enclosed perimeter to zero. Further rotation of ring $r_1$ (to positions 4 and 5 at 270° and 360° of relative rotation, respectively) further intertwines the strands about the bight. It will be apparent that a liner trapped in the bight will be pulled closed.

Based on the description above, the artisan will appreciate the many variations possible on this basic arrangement and relative movement of constrictor elements. The elements may be rigid members (such as slender rods), pivotally coupled to fixed and movable rings. The relative rotation would then be limited to 180°, at which point the rods engage each other and prevent further rotation. Further, the distance between the rings along the longitudinal axis would necessarily change as the movable ring is rotated (the lengths of the rigid members being fixed). Thus, the constrictor would behave as shown in positions 1–3 of FIGS. 10A–B, except that the rings would move closer together as ring $r_1$ is rotated. Alternatively, the rods could be coupled to one or both of the rings by sliders, so that the spacing between the rings could remain constant. As a further alternative, the members may be articulated by including a rotatable joint in the middle of each member, at the position at which the bight B would form. The articulated members could then wrap around each other at the bight, permitting more than 180° of relative rotation. Such a constrictor would behave substantially as shown in positions 1–5 of FIGS. 10A–B.

The constrictor elements described above (strands, rigid members) have minimal peripheral extent, and can be viewed as one-dimensional tension members connected at each end at a single point on the respective ring. Alternatively, the constrictor elements may have a finite width, or peripheral extent, and considered as two-dimensional tension members, attached at two or more points at each end on the respective ring. At the limit, such a constrictor is a continuous sleeve, as illustrated in FIGS. 9A–B. In this embodiment, the constrictor is a flexible sleeve 300, shown in the open position in FIG. 9A and the closed position in FIG. 9B. These figures show the ends P, P' of one of eight virtual tension members between corresponding posts 277 (on twist ring 250) and 235 (on inner sleeve support portion 230 of main cover 200). Since the rings are separated by a longitudinal distance substantially less than their diameter, the inelastic, flexible sleeve 300 hangs loosely, depending straight down from sleeve support portion 230 and sleeve retaining rim 280 and does not obstruct waste passage 400.

When the twist ring 250 is rotated through its full range of approximately 180° (by rotating handle 265) to the closed position as shown in FIG. 9B, the ends P, P' of the virtual tension member are opposed, and sleeve 300 is pulled taught. With the sleeve twisted closed, waste passage 400 and the remaining volume between lid assembly 130, main cover 200, and upper surface of closed sleeve 300 defines a holding chamber 500 that is fluidically isolated from storage chamber 600. Note that the bag does not twist shut. Instead, the twisting of flexible sleeve 300 pinches bag 700 shut. Therefore after flexible sleeve 300 is opened, the weight of the waste material simply opens bag 700 (if it does not reopen by itself) as it fails from holding chamber 500 into storage chamber 600.

Figure 11A:
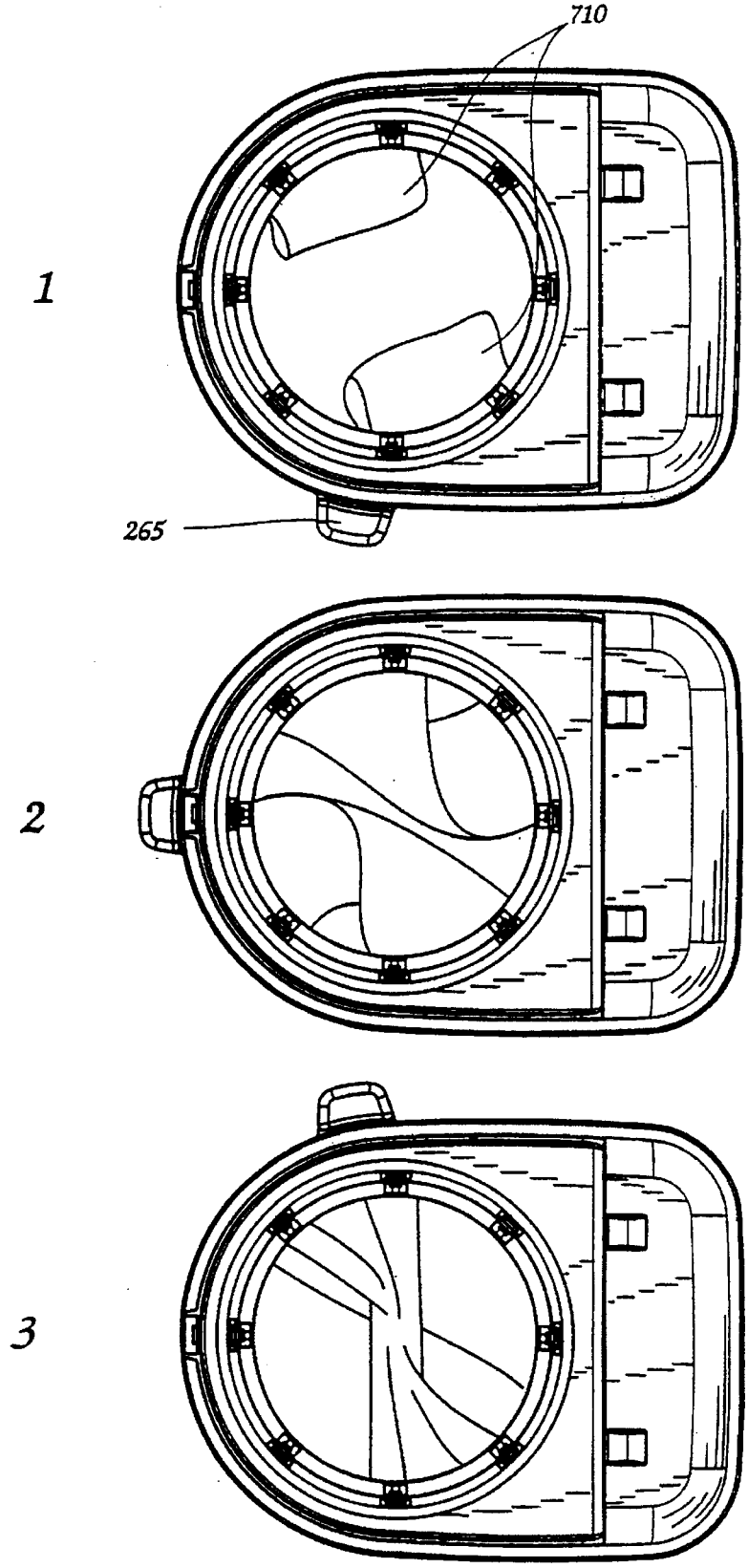
FIGS. 11A–B are top and side elevation views of another embodiment of a peripheral constrictor with two constrictor elements in several positions.
Figure 11B:
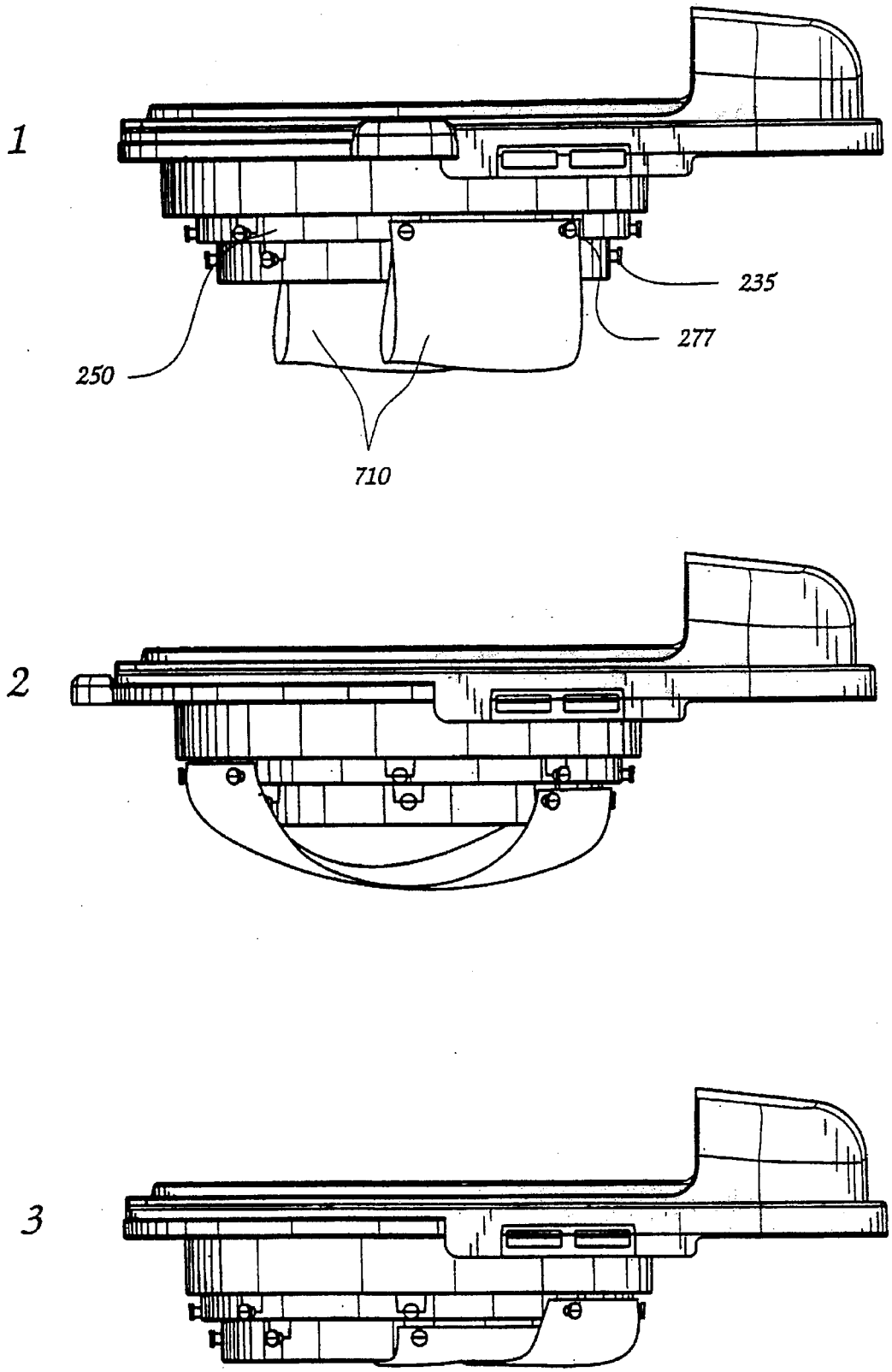

Another embodiment is illustrated in FIGS. 11A–B, in which the constrictor elements are fabric strips 710, each spanning approximately 45° of the perimeter of the rings (which are configured as illustrated in the first embodiment). Each strip 710 has two button holes at each end to permit attachment to two adjacent posts 277 and 235 on the fixed and movable rings, respectively. Positions 1–3 in FIGS. 11A–B illustrate the operation of the constrictor at 0°, 90°, and 180° of relative rotation of the two ends of the constrictor, respectively.

The strips 710 can be viewed as segments of the sleeve 300 illustrated in the previous embodiment. The strips 710 (and the sleeve 300, as weld can also be attached to the rings continuously (rather than at discrete points such as the posts 277, 235) such as by hook-and-loop tape (if desired to be removable), by suitable adhesive (if not to be removable), etc. Each strip could then be considered to include many constituent tension members, thus forming an aggregate of constrictor elements.

In some variations on the strip construction for the constrictor elements, it is possible for the constrictor to form a substantial barrier to the flow of air-borne odors through the passage. For example, if the strips are sufficiently wide (extend over a sufficiently large portion of the periphery of the rings), they will overlap. When pulled taught in the closed position of the constrictor, the strips will not present any gaps that would permit the flow of air. Alternatively, if the rings are so arranged that the two ends of the strips pass across each other (as in the constrictor illustrated above and in FIG. 12, in which the strips pass across the lower rim of the lower ring and thus pass across a common plane), the same effect could be achieved by narrower strips (i.e., strips that do not overlap at their connections to each ring). This is achieved by having strips sufficiently wide that the ends of the strips connected to one ring cover the gaps between the ends of the strips attached to the other ring. Appropriately configured (including the selection of an air-impermeable material), the strips could effectively seal the passage.

As described above, in the closed position of the constrictor, the ends of the constrictor elements need to be angularly displaced by at least 180° with respect to each other to close the passage through the constrictor, and to achieve better closure, relatively displacement of more than 180° is preferred. This relative displacement need not be achieved by rotating one end about the longitudinal axis through the entire displacement. Instead, the two ends can be displaced in the fully open position of the constrictor by some amount (an advance angle) and then further displaced by rotation of one end of the constrictor by another amount (a rotation angle), provided that the total displacement (the sum of the advance and rotation angles) is 180° or more. A substantial advance angle is preferred when the configuration of the container is such that the rotation angle cannot be more than 180°. This is the case with the container illustrated above, because the angular range of motion of twist ring 250 is limited to approximately 180°.

Figure 13A:
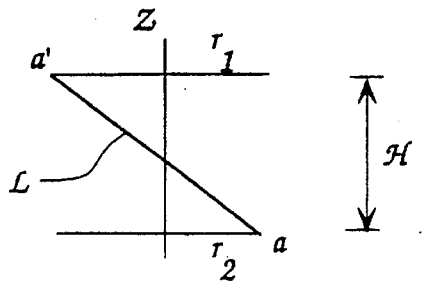
FIGS. 13A–D schematically illustrate the selection of design parameters for a constrictor.

It is preferred to use an advance angle that is less than the angle at which the passage through the constrictor is reduced in perimeter in the fully open position below the perimeter of the smaller of the two rings, to allow the largest possible object to be inserted through the constrictor. This maximum advance angle varies with the design of the constrictor. For example, since in sleeve 300 the constituent tension members are peripherally interconnected about the entire periphery of the constrictor, the maximum advance angle is small. A much larger advance angle is possible with a peripherally-segmented constrictor. This is illustrated below in the simplest case of the two-strand constrictor shown in FIG. 10A and C. As shown in FIG. 13A, for an inelastic, flexible, one-dimensional constrictor element, the element's length L is related to the radii $r_1$, $r_2$ of two rings longitudinally spaced by a distance H by:

$$L=\sqrt{H^2+(r_1+r_2)^2} \tag{1}$$

Figure 13B:
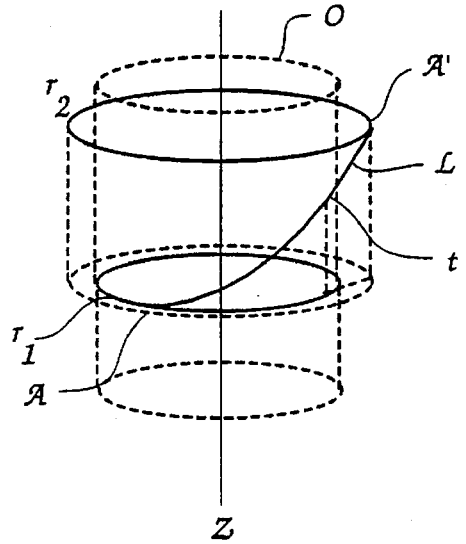
Figure 13C:
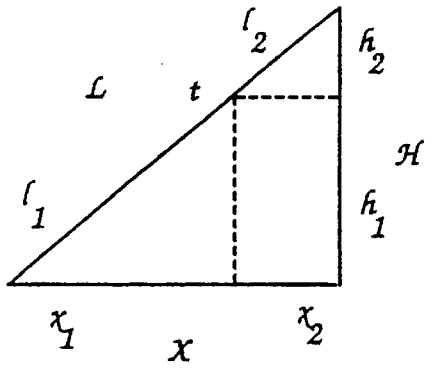
Figure 13D:
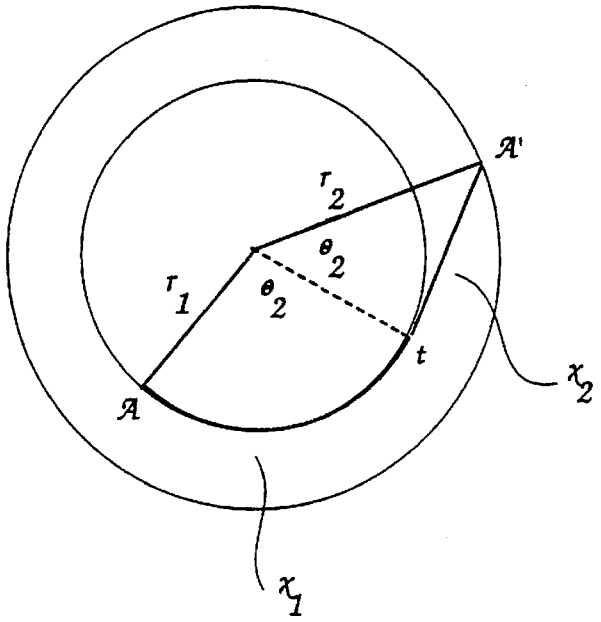
Figure 14A:
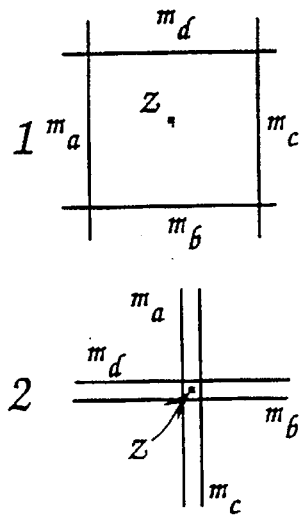
FIGS. 14A–B are top and side elevation views of another embodiment of a peripheral constrictor with four constrictor elements
Figure 14B:
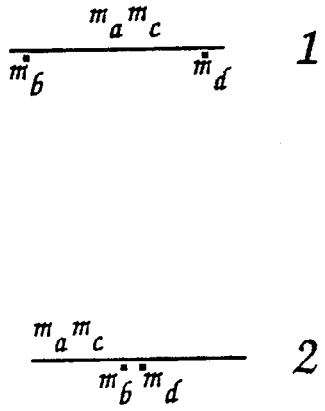

As illustrated in FIG. 13B, to permit passage of a cylindrical object O with a diameter equal to that of the smaller ring, there is a maximum advance angle Θ at which the constrictor elements can just be pushed aside, wrapping around the object from each element's attachment point A to the smaller ring to a point of tangency t, then running linearly to the attachment point A' on the larger ring. If the path taken by a constrictor element is "unrolled" into a plane, it will be triangular, as shown in FIG. 13C. The length X of the path of the constrictor element projected into a plane parallel to the rings is related to H and L by:

$$X=\sqrt{L^2-H^2} \tag{2}$$

Substituting Eq. (1) into Eq. (2), X can therefore be expressed as:

$$X=r_1+r_2 \tag{3}$$

X has a component $x_2$ corresponding to the portion $1_2$ of the constrictor element where it runs between the two diameters. The length $x_2$ is related to the rings' radii by:

$$x_2=\sqrt{r_2^2-r_1^2} \tag{4}$$

The length of segment $x_1$ is equal to the difference between X and $x_2$, or (combining Eqs. (3) and (4)):

$$x_1=r_1+r_2-\sqrt{r_2^2-r_1^2} \tag{5}$$

The angle $\theta_1$ (in radians) subtended by $x_1$ is the ratio of $x_1$ to $r_1$, or:

$$\theta_1=\frac{r_1+r_2-\sqrt{r_2^2-r_1^2}}{r_1} \tag{6}$$

The angle $\theta_2$ subtended by $x_2$ is:

$$\theta_2=\cos^{-1}\left(\frac{r_1}{r_2}\right) \tag{7}$$

The maximum advance angle Θ is the sum of $\theta_x$ and $\theta_2$, or:

$$\Theta=1+\frac{r_2-\sqrt{r_2^2-r_1^2}}{r_1}+\cos^{-1}\left(\frac{r_1}{r_2}\right) \tag{8}$$

By way of example, ff the two ring diameters are the same ($r_1=r_2$), then Θ=2 radians, or 115°.

Although the embodiments illustrated above show only two constrictor elements (strands or strips), the artisan will recognize that the constrictor can be formed of any number (greater than one) of constrictor elements. Further, although the elements have been illustrated as being symmetrically spaced around the longitudinal axis of the constrictor, they can be asymmetrically spaced.

The embodiments described above employ constrictor elements that have one end fixed and the other end rotated about a longitudinal axis. Further alternative embodiments employing different configurations and arrangements of constrictor elements are illustrated in FIGS. 14A–17. These alternative embodiments are intended to illustrate only some of the many possible variations on the peripheral constrictor which will be evident to the artisan.

The constrictor may employ constrictor elements that are disposed for movement in a plane, or adjacent planes, generally perpendicular to the longitudinal axis of the constrictor. For example, in the embodiment illustrated schematically in FIGS. 14A–B, four rigid members $m_a$, $m_b$, $m_c$, and $m_d$ are arranged about the longitudinal axis Z of the constrictor in two closely spaced planes. The members are movable laterally toward each other between an open position (1) and a closed position (the illustrated position 2 being shown nearly closed for clarity). Again, it will be apparent to the artisan that a liner disposed in the space between the members will be pinched closed as the member meet in the closed position. Although not illustrated, the members could be slightly spaced longitudinally to pass by each other laterally rather than meeting, giving even more secure closing of the liner.

Figure 15:
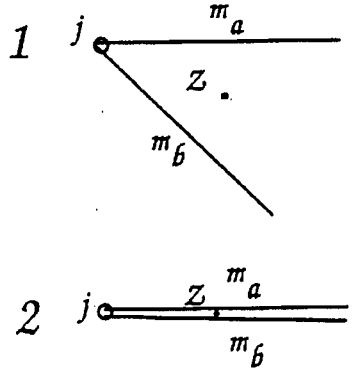
FIGS. 15–17 are top views of three further embodiments of a peripheral constrictor.

A further alternative embodiment is illustrated in FIG. 15. In this embodiment, two members $m_a$ and $m_b$ are pivotally coupled by a joint j, and can be pivoted relative to each other about joint j substantially in a plane to restrict and close the periphery surrounding a liner. Of course, a further member could be pivoted to the other end of either member to form a triangular arrangement.

Figure 16:
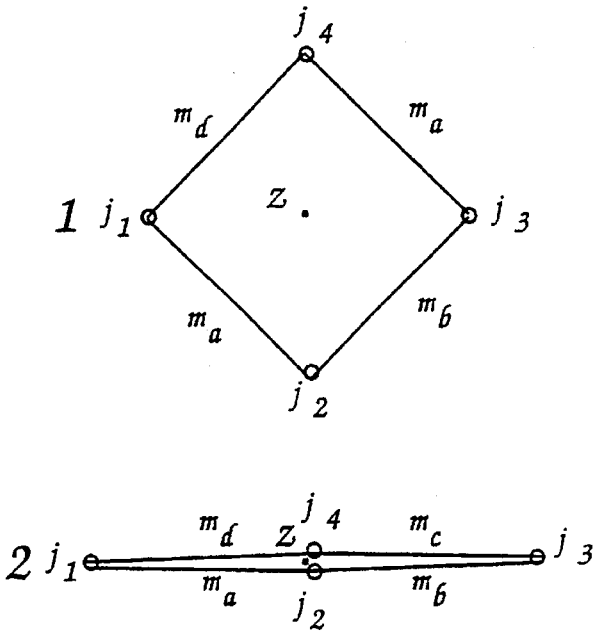
Figure 17:
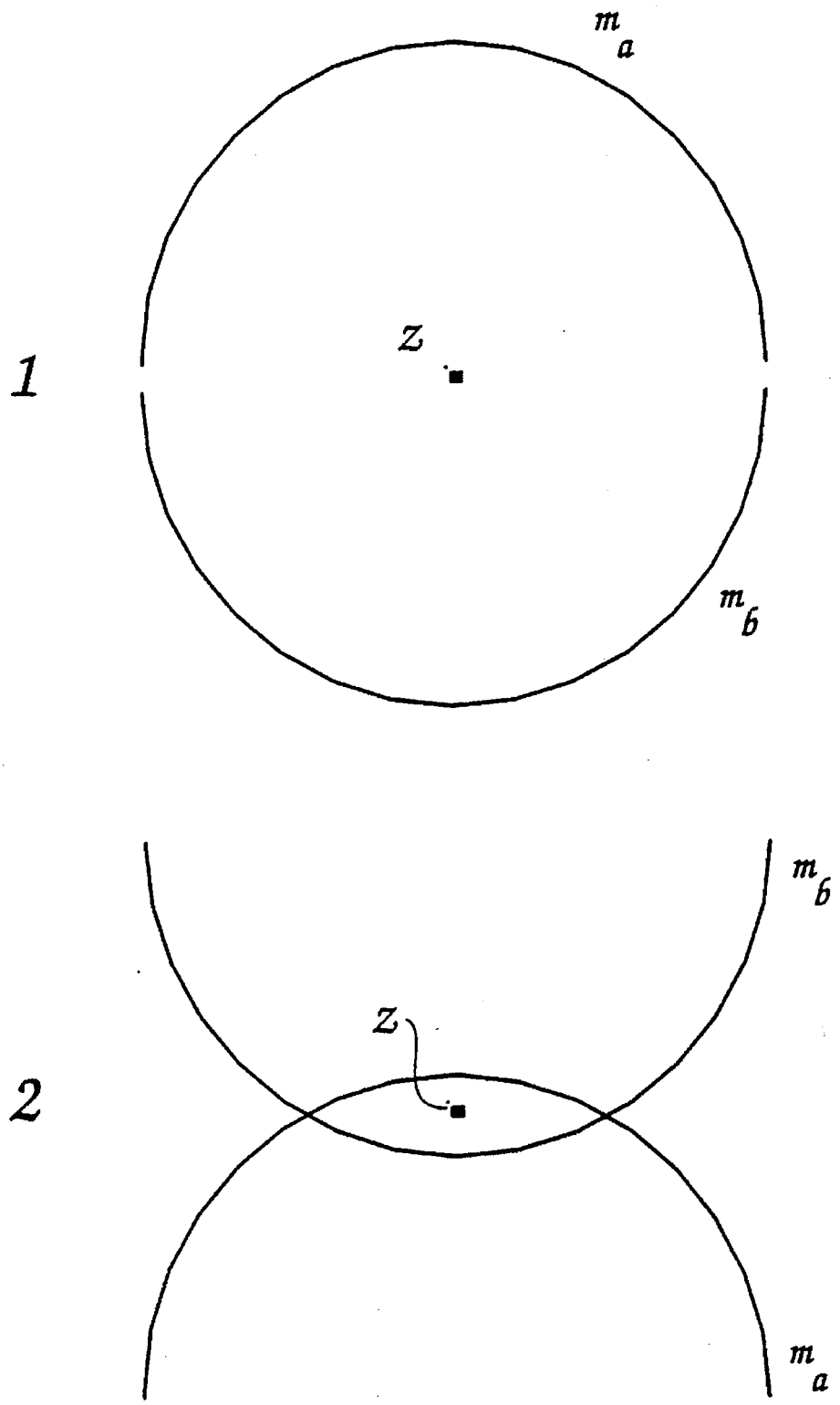

FIG. 16 schematically illustrates a further embodiment in which four rigid members $m_a$, $m_b$, $m_c$, and $m_d$ are pivotally connected by four joints $j_1$, $j_2$, $j_3$, and $j_4$. The members can be moved toward each other in a plane substantially perpendicular to the longitudinal axis Z of the constrictor, pinching the sidewall of a liner closed.

Although the preceding embodiments have illustrated the constrictor elements as being linear, they may also be arcuate or any other suitable geometry. For example, in the embodiment schematically illustrated in FIG. 17, the members $m_a$ and $m_b$ are arcuate, and are arranged with their concave sides arranged toward the longitudinal axis Z. The members are movable toward the axis and each other, overlapping in the closed position (the position illustrated in position 2 being nearly closed for clarity).

With respect to any of these embodiments, any of the illustrated members could be fixed with respect to the container or even an integral part of the container, with the other member or members moving toward the fixed member.

Some of the embodiments of the odorless container 100 will work without a liner, such as the continuous sleeve or overlapping strip embodiments described above. However, it is contemplated that in most Of the constrictor embodiments that the constrictor elements will not block the passage in the constrictor's closed position—the cross-sectional area of the constrictor perpendicular to the longitudinal axis is less than the cross-sectional area of the passage.

Thus, it is contemplated that the constrictor is most effectively used with a liner such as an appropriately sized plastic bag. The closed end of bag 700 is inserted through waste passage 400 so that its closed end rests on bottom wall 120 of pail 110. As shown in FIG. 9A, the open end of bag 700, with the excess bag material (which is a result of the bag's diameter being greater than that of bag retainer 150), is then folded under outer rim 165 of bag retainer 150.

Figure 12:
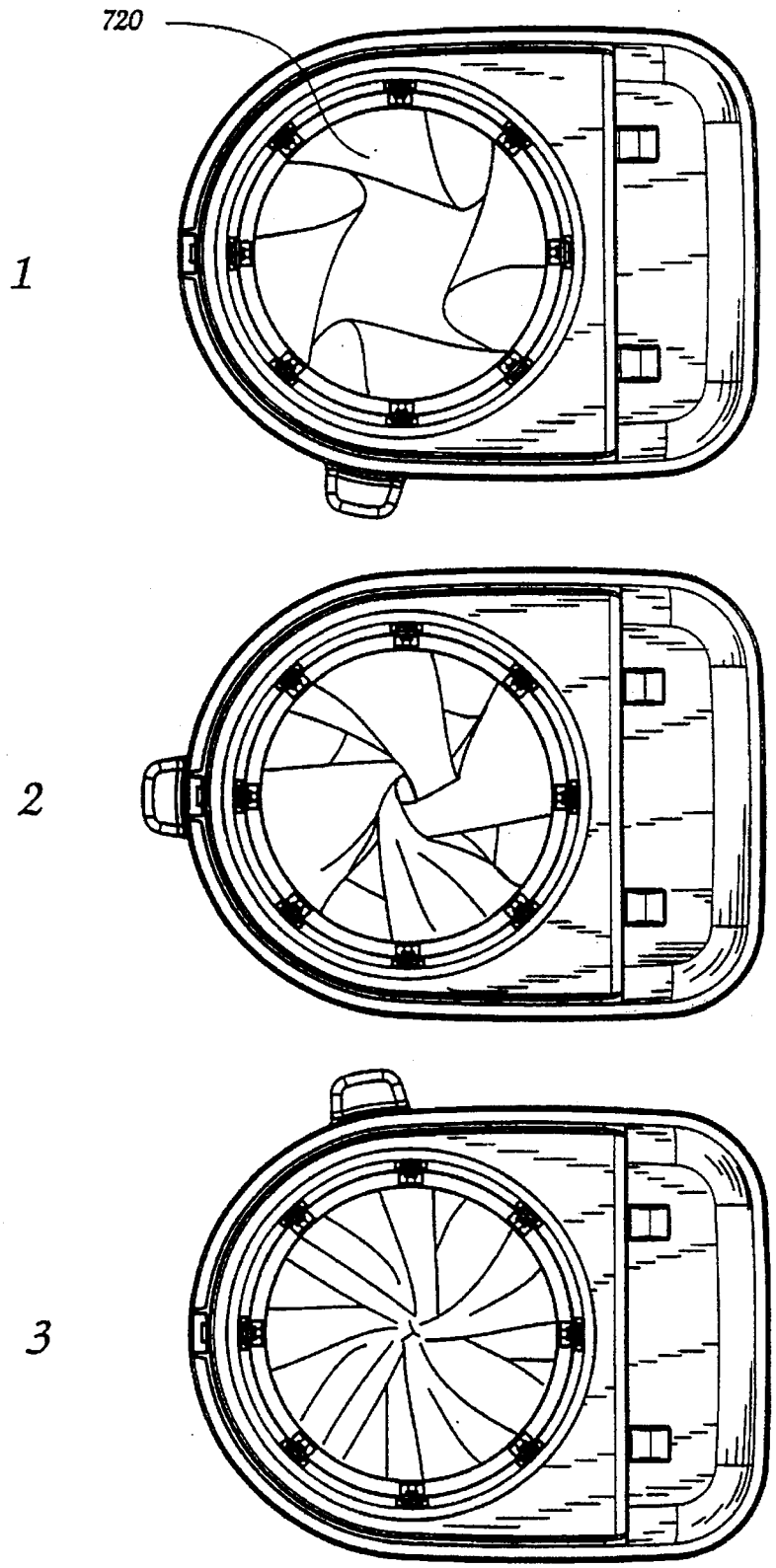
FIG. 12 is a top view of another embodiment of a peripheral constrictor with four constrictor elements in several positions.

It is presently preferred that the constrictor to be used with the container illustrated in FIGS. 1–9 employs four equally-spaced, flexible, relatively inelastic, fabric strips 720, each strip being mounted at each end to two posts (thus spanning approximately 45°. The advance angle is 45° and the rotation angle is approximately 180°. This embodiment is illustrated in FIG. 12 in open, intermediate, and closed positions (1–3).

OPERATION

The operation of the odorless container will now be described in connection with the first embodiment (using sleeve 300). Before using odorless container 100, container 100 is put into the receiving state by rotating handle 265 of twist ring 250 to the closed position indicated by letter A of FIG. 1D, which closes flexible sleeve 300, pinches the bag shut, and isolates the two chambers as shown in FIG. 9B. Twist ring 250 will remain in its selected position (either open or closed) due to frictional forces between itself and both main cover 200 and front portion 124 of beaded rim 123 of pail 110.

To operate odorless container 100, the user opens lid assembly 130, deposits the waste material into holding chamber 500, and closes lid assembly 130. Next, the user rotates handle 265 from the closed position (indicated by letter A in FIG. 1D) to the open position (shown in phantom and indicated by letter B). The weight of the waste material will urge the bag and flexible sleeve 300 open so that the material will fall from holding chamber 500 into storage chamber 600. By observing the interior of odorless container 100 through window 137 of lid assembly 130, the user can determine when the waste material has fallen into storage chamber 600. The user will then rotate handle 265 from the open position to the closed position to put odorless container 100 back into the receiving state.

The user can also determine whether or not storage chamber 600 is full by observing the interior of odorless container 100 through window 137 when flexible sleeve 300 is opened. When storage chamber 600 is full (i.e., waste has piled up to a point slightly below the bottom of passage 400), the user simply closes flexible sleeve 300, opens lid assembly 130, removes the open end of bag 700 from bag retainer 150, and ties the open end of bag 700 shut with a conventional tying device such as a twist-tie. With bag 700 tied shut, the user opens flexible sleeve 300, removes the cover assembly from open end 122 of pail 110, and removes bag 700 from pail 110. The user then discards bag 700 in an appropriate fashion and installs a new bag in odorless container 100 as previously described.

Although the illustrated embodiment incorporates a bag retainer, the liner could be fixedly attached in any conventional manner to main cover 200, thus eliminating the need for a separate bag retainer. Although the length of flexible tube 300 in this embodiment is such that it will just barely reach across passage 400, the invention would work with a longer flexible sleeve by rotating the twist ring more than 180°. Furthermore, in other embodiments for use with other waste materials a more substantial and thicker liner may be required. Consequently, a somewhat shorter or longer flexible sleeve may more effectively pinch the liner closed depending on the thickness of the liner, the angular rotation of twist ring 250, and the elasticity of flexible sleeve 300.

In the previously described embodiment, twist ring 250 was held in place by frictional forces between twist ring 250, pail 110, and main cover 200. If an extremely tight seal is needed, a locking mechanism could be used to lock twist ring 250 in a closed position in which flexible sleeve 300 is pulled to an extremely tight closed position.

Although in the illustrated embodiment twist ring 250 rotates and main cover 200 is fixed, the invention would work equally well (with minor design changes apparent to the artisan) with a twist ring that is fixed and a rotatable main cover.

What is claimed is:

1. A receptacle, comprising:

a container having an interior and an open end;

a first ring coupled to said container;

a second ring rotatably coupled to said container and disposed concentrically with said first ring;

a passage through said rings between said open end and said interior of said container;

a liner traversing said passage and having a peripheral sidewall lining said passage; and a constrictor disposed about said passage and having a first end coupled to said first ring and a second end coupled to said second ring, said constrictor having a plurality of constrictor elements, each of said constrictor elements having a first end corresponding to said first end of said constrictor and a second end corresponding to said second end of said constrictor, rotation of said second ring from a first, open position to a second, closed position urging said liner sidewall together to close the liner and thereby dose said passage.

2. The receptacle of claim 1, further comprising an actuator permitting rotation of said second ring from outside said container.

3. The receptacle of claim 1, wherein said container includes a pail having an open end and a cover movably mounted to said open end of said pail to selectively close said open end of said pail.

4. The receptacle of claim 3, wherein said liner comprises a bag having a closed end disposed in said pail and an open end adjacent said open end of said pail.

5. A receptacle, comprising:

a container having an interior and an open end;

a first ring coupled to said container;

a second ring rotatably coupled to said container and disposed concentrically with said first ring;

a passage through said rings between said open end and said interior of said container;

a peripheral constrictor disposed about said passage and having a first end coupled to said first ring and a second end coupled to said second ring, said constrictor comprising a plurality of flexible constrictor elements, each of said constrictor elements having a first end corresponding to said first end of said constrictor and a second end corresponding to said second end of said constrictor, each of said constrictor elements having a width that is a substantial fraction of the peripheral extent of said passage, rotation of said second ring from a first, open position to a second, closed position causing said constrictor elements to interengage and to overlap to substantially inhibit the passage of air through said passage.

6. The receptacle of claim 5 wherein said first and second ends of said constrictor elements are substantially adjacent, said first ends of said constrictor elements overlapping with said second ends of said constrictor elements when said constrictor is in said closed position.

7. The receptacle of claim 5 wherein said constrictor elements having a sufficient width that either of said first ends or said second ends of said constrictor elements overlap each other when said constrictor is in said closed position.

8. A receptacle for receiving waste and containing odors emanating from the waste, comprising:

a container having an open end, a closed end, and a sidewall therebetween;

a first chamber having a first and a second end;

a lid disposed at said first end of said first chamber;

a second chamber adjacent said second end of said first chamber and defined at least partially by said closed end and sidewall of said container;

a passage coupling said first chamber to said second chamber and having a predetermined cross-sectional area; and a bag formed of a substantially air-impermeable material having a first, open end disposed in said first chamber, a second, closed end disposed in said second chamber, and a peripheral sidewall between the two ends disposed at least partially in said passage, said bag being releasably retained in said receptacle;

a cover mounted to said open end of said container, said lid being mounted to said cover for movement between an open position and a closed position;

said first chamber being at least partially defined by said cover and said lid when said lid is in said closed position;

a constrictor disposed about said passage and said peripheral sidewall of said bag and being movable between an open position having a predetermined peripheral extent and a closed position having substantially no peripheral extent, said constrictor urging said sidewall of said bag together in said second position to close said bag and thereby dose said passage, isolate said chambers, and prevent air-borne odors from passing from one of said chambers to the other said chambers through said bag, said constrictor being moveable between said open and closed positions when said lid is in said closed position;

an actuator coupled to said constrictor and to said cover, and actuable from the exterior of said container when said lid is in said closed position to move said constrictor between said open and closed positions;

said first chamber being in a first state when said constrictor is in said closed position and said lid is in said open position, said first chamber being substantially fluidically isolated from said second chamber and accessible from the exterior environment of said receptacle;

said first chamber being in a second state when said constrictor is in said closed position and said lid is in said closed position, said first chamber being substantially fluidically isolated from said second chamber and from the exterior environment of said receptacle;

said first chamber being in a third state when said constrictor is in said first open position and said lid is in said closed position, said first chamber being in fluidic communication with said second chamber and substantially fluidically isolated from the exterior environment of said receptacle;

whereby waste can be deposited into said first chamber when said first chamber is in said first state, waste deposited in said first chamber can be substantially fluidically isolated from the exterior environment by movement of said lid from said open position to said closed position to change said first chamber from said first state to said second state, and the waste can move from said first chamber to said second chamber without permitting fluidic communication between said second chamber and the exterior environment when said first chamber is changed from said second state to said third state.

9. The receptacle of claim 8 wherein said constrictor has a cross-sectional area substantially less than said cross-sectional area of said passage and is therefore incapable of closing said passage except in cooperation with said bag.

10. The receptacle of claim 8 wherein said constrictor can be repeatedly moved between said open and closed positions to selectively close said passage in cooperation with said bag.

11. The receptacle of claim 10 further including a bag retaining member disposed substantially in said first chamber and engaging said first end of said bag to retain said bag in said first chamber.

12. The receptacle of claim 11 wherein said bag retaining member is detachably mounted to said cover.

13. The receptacle of claim 8 wherein said constrictor has a longitudinal axis and a first, fixed end and an opposite, second, movable end disposed along said longitudinal axis, said second end being movable about said longitudinal axis with respect to said first end between a first position corresponding to said open position of said constrictor and a second position corresponding to said closed position of said constrictor, said constrictor comprises first and second constrictor elements with each of said constrictor elements having a first end corresponding to said first end of said constrictor and a second end corresponding to said second end of said constrictor.

14. A diaper pail comprising:

a container having an open end and a closed end;

a bag disposed inside the container and having an open end, a closed end, and sides extending therebetween;

a constrictor supported by the container and operable to urge the sides of the bag together thereby defining a lower chamber by said closed end of said bag and the portion of said sides of said bag below said constrictor and defining an upper chamber above the constrictor at least partially by the portion of said sides of said bag above said constrictor, said constrictor being movable between a first position in which the sides of the bag are urged together to isolate the chambers from each other and a second position in which the sides of the bag are spaced from each other to allow said chambers to communicate; and said constrictor has a longitudinal axis, a first fixed end and an opposite, second, movable end disposed along said longitudinal axis, said second end being movable about said longitudinal axis with respect to said first end between a first position corresponding to said open position of said constrictor and a second position corresponding to said closed position of said constrictor;

said constrictor including a plurality of constrictor elements, each of said constrictor elements having a first end corresponding to said first end of said constrictor and a second end corresponding to said second end of said constrictor, each of said constrictor elements being disposed for movement substantially in a plane perpendicular to said longitudinal axis, said constrictor elements moving toward said longitudinal axis when said constrictor is moved from said open position to said closed position;

a lid mounted on the container for closing the open end of the container, at least partially defining said upper chamber, and isolating said upper chamber from the ambient environment, whereby a diaper may be disposed of by opening said lid, placing the diaper in said upper chamber, closing said lid, and moving said constrictor to said second position to allow the diaper to pass from said upper chamber to said lower chamber.

15. The diaper pail of claim 14 wherein said container further includes a cover supported on said open end of said container, said lid and said constrictor being mounted to said cover, and said upper chamber being defined at least partially by said cover.

16. The diaper pail of claim 14, further comprising:

a cover mounted to said open end of said container wherein said lid is mounted to said cover; and a bag retaining member at least partially disposed in said first chamber for retaining said bag.

17. The receptacle of claim 14 wherein said constrictor comprises a plurality of constrictor elements, each of said constrictor elements having a first end corresponding to said first end of said constrictor and a second end corresponding to said second end of said constrictor.

18. The receptacle of claim 17 wherein said constrictor elements are symmetrically disposed about said longitudinal axis.

19. The receptacle of claim 17 wherein said second ends of said constrictor elements are angularly displaced about said longitudinal axis with respect to said first ends of said constrictor elements in said first constrictor position by a predetermined advance angle, and said second end of said constrictor is rotatable with respect to said first end of said constrictor by a predetermined rotation angle, the sum of said advance angle and said rotation angle being at least approximately 180°.

20. The receptacle of claim 29 wherein each of said constrictor elements is flexible and the sum of said advance angle and said rotation angle is substantially greater than 180°.

21. The receptacle of claim 20 wherein said advance angle is approximately 45° and said rotation angle is approximately 180°.

22. The receptacle of claim 17 wherein each of said constrictor elements comprises a substantially rigid member.

23. The receptacle of claim 22 wherein said constrictor members are arcuate, having a concave side disposed toward said longitudinal axis.

24. The receptacle of claim 17 wherein each of said constrictor elements comprises an articulated member having two substantially rigid segments coupled by a flexible joint.

25. The receptacle of claim 17 wherein each of said constrictor elements is flexible.

26. The receptacle of claim 25 wherein each of said constrictor elements comprises a strip of material having a width that is a substantial fraction of the peripheral extent of said passage.

27. The receptacle of claim 25 wherein each of said constrictor elements comprises a strand of material.

28. The receptacle of claim 25 wherein each of said constrictor elements is formed of an elastic material.

29. A method of disposing of waste in a receptacle that prevents the escape of offensive odors, the receptacle having a container with an open end and a closed end and sidewalls therebetween, a bag disposed in the container and having an open end, a closed end, and sides extending therebetween, a cover mounted to the open end of the container, a partitioning member supported by the cover operable to urge the sides of the bag together to define a lower chamber by the closed end of the bag and the portion of bag sides below the partitioning member and defining an upper chamber above the partitioning member at least partially by the portion of the bag sides above the partitioning member, a bag retaining member for engaging the open end of the bag, an actuator coupled to the cover and to the partitioning member to operate the partitioning member and a lid pivotally mounted to the cover for closing the open end of the container, at least partially defining the upper chamber, and isolating the upper chamber from the ambient environment, comprising the steps of:

a. opening the lid;

b. depositing an item of waste into the upper chamber;

c. closing the lid;

d. opening the partitioning member to allow the waste to move from the upper chamber into the lower chamber;

e. closing the partitioning member to pinch the bag closed;

f. repeating steps a–e with a second item of waste; and g. removing the bag.

30. The method of claim 29, wherein the step of removing the bag comprises the steps of:

opening the lid;

disengaging the bag from the bag retaining member;

fixedly closing the bag;

opening the partitioning member;

removing the cover; and removing the bag.

* * * * *